US010573129B2

(12) United States Patent
Higgins et al.

(10) Patent No.: US 10,573,129 B2
(45) Date of Patent: Feb. 25, 2020

(54) CASHLESS GAMING THROUGH VIRTUAL TICKETING IN A GAMING SYSTEM

(71) Applicant: IGT, Las Vegas, NV (US)

(72) Inventors: Kevin Higgins, Reno, NV (US); Erik Petersen, Reno, NV (US)

(73) Assignee: IGT, Las Vegas, NV (US)

( * ) Notice: Subject to any disclaimer, the term of this patent is extended or adjusted under 35 U.S.C. 154(b) by 91 days.

(21) Appl. No.: 15/859,553

(22) Filed: Dec. 31, 2017

(65) Prior Publication Data

US 2019/0206190 A1 Jul. 4, 2019

(51) Int. Cl.
*A63F 9/24* (2006.01)
*G07F 17/32* (2006.01)

(52) U.S. Cl.
CPC ..... *G07F 17/3248* (2013.01); *G07F 17/3213* (2013.01); *G07F 17/3218* (2013.01); *G07F 17/3223* (2013.01); *G07F 17/3239* (2013.01); *G07F 17/3246* (2013.01); *G07F 17/3251* (2013.01); *G07F 17/3258* (2013.01)

(58) Field of Classification Search
None
See application file for complete search history.

(56) References Cited

U.S. PATENT DOCUMENTS

2004/0043814 A1* 3/2004 Angell ..... G07F 17/0014 463/25
2006/0281541 A1* 12/2006 Nguyen ..... G07F 17/32 463/25
2013/0065686 A1* 3/2013 LeMay ..... G07F 17/32 463/37
2013/0130778 A1* 5/2013 Anderson ..... G07F 17/3223 463/25

* cited by examiner

*Primary Examiner* — Lawrence S Galka
(74) *Attorney, Agent, or Firm* — Sheridan Ross P.C.

(57) ABSTRACT

Various technology for operating an electronic gaming machine (EGM) is disclosed. The EGM may comprise (a) a communication module; (b) a virtual ticket interface converter module; (c) an input device; (d) a payment device; (e) a payout device; (f) a memory device; and (g) a processor executing instructions stored in the memory device. The processor, when executing the instructions stored in the memory device, may intercept communications between the input device, the payment device and the payout device using the virtual ticket interface converter module such that financial transactions between a player and the EGM are routed through a virtual mobile wallet account notwithstanding the virtual ticket interface converter module authenticates the financial transactions with the EGM as if the financial transactions were physically performed using the payment device and the payout device.

20 Claims, 14 Drawing Sheets

CASHLESS GAMING THROUGH VIRTUAL TICKETING IN A GAMING SYSTEM

BACKGROUND

The present disclosure relates in general to gaming devices and systems, and more particularly to cashless gaming through the use of virtual ticketing in a gaming system.

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of electronic games. Many electronic gaming machines (EGMs), such as slot machines and video poker machines, have been a cornerstone of the gaming industry for several years. The EGMs include specially programmed computers and contain multiple external interfaces. Further, the EGMs may provide mobile services such as funds transferring and game functionality within the gaming establishments to mobile or "player" devices.

BRIEF SUMMARY

Various embodiments providing EGMs, EGM systems, and methods of operating EGMs are disclosed herein. In one embodiment, the EGM may comprise (a) a communication module; (b) a virtual ticket interface converter module; (c) an input device; (d) a payment device; (e) a payout device; (f) a memory device; and (g) a processor executing instructions stored in the memory device. The processor, when executing the instructions stored in the memory device, may intercept communications between the input device, the payment device and the payout device using the virtual ticket interface converter module such that financial transactions between a player and the EGM are routed through a virtual mobile wallet account notwithstanding the virtual ticket interface converter module authenticates the financial transactions with the EGM as if the financial transactions were physically performed using the payment device and the payout device. Additional embodiments are disclosed and provide related advantages.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Aspects of the present disclosure are illustrated by way of example and are not limited by the accompanying drawings.

DETAILED DESCRIPTION

Figure 1:
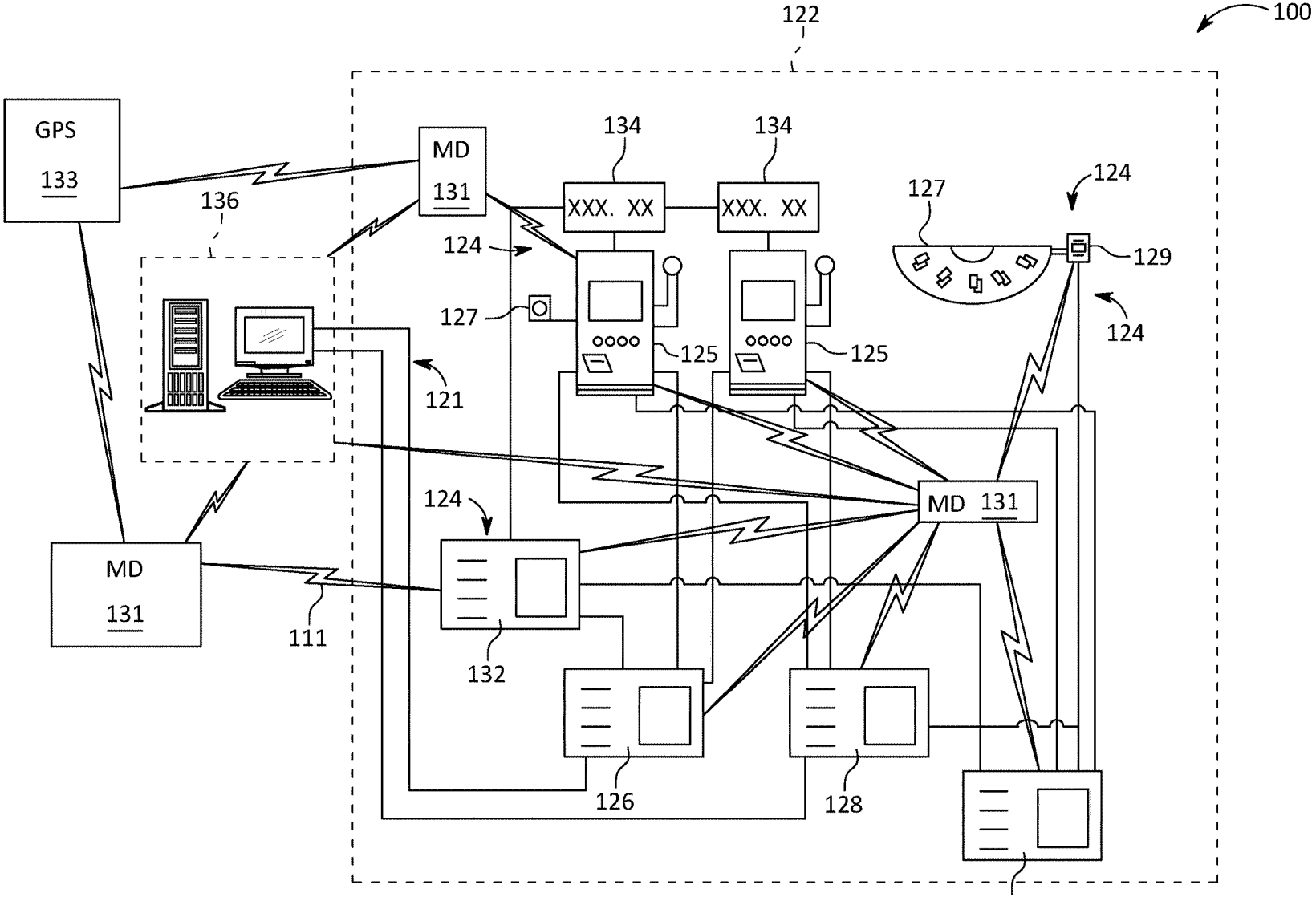
FIG. 1 is a block diagram illustrating a gaming system environment with a gaming terminal data repository (GTDR) connected via one or more network interface(s) to a gaming network which, for example, may include gaming devices (e.g., gaming terminals)

In general, EGMs require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such EGMs, the amount of the wager made on the base game by the player may vary. Secondary games and progressive awards are also generally provided to further extend gameplay and enhance the experience of the player.

Users or players of these EGMs have a general interest in using their various external devices (e.g., mobile devices such as cell phones, electronic tablets, computers, and the like) in casinos and other gaming venues for receiving one or more winnings, such as a gaming award, gaming bonus, progressive award, and/or jackpots. There are benefits to allowing players to use their mobile devices (smartphones, tablets, etc.), in conjunction with virtual gaming accounts (managed through gaming establishment issued cards) to transfer money to and from EGMs and gaming kiosks (such as convenience, security, and accounting benefits), and much of the industry is increasingly reliant on mobile/virtual technology to receive wager funding from players and fund the one or more winnings associated with gameplay.

To with, some gaming establishments have developed (or currently are developing) card-less and cashless ecosystems which allow patrons to fund games and pay for goods and services using various gaming establishment application(s) on their mobile device. These applications are often linked to a cashless or virtual account managed by the gaming establishment which may in turn be linked to one or more financial institution accounts (e.g., bank, credit union, or other external funding accounts). While many gaming operators are optimistic about this approach, this type of system does not come without deficiencies. In particular, the gaming establishment management application(s) providing cashless wagering are generally designed to operate within a particular manufacturer's or gaming institution's line of products, thus posing challenges for cross-compatibility with a third-party system. In other words, third-party casino management systems may not provide compatibility for one EGM manufacturer to initiate cashless transactions at a particular EGM when the EGM is not manufactured by the same entity providing the casino management system. While existing casino management and accounting systems are generally compatible with third-party ticketing systems (such as the IGT® EZ Pay® ticketing system), these casino management and accounting systems may not be compatible with a third-party cashless wagering system.

Accordingly, the functionality considered by the present disclosure provides technology to integrate third-party casino management systems and cashless wagering systems by the use of virtual ticketing. These mechanisms are implemented by incorporating a component into the EGM termed herein as a "virtual ticket interface converter module" or more simply a "virtual ticket converter", which will be further described, following. The virtual ticket interface converter module, may, in one embodiment, intercept communications between an input device (such as a card reader), a payment device (such as a bill acceptor/validator), and a payout device (such as a ticket printer) of the EGM such that financial transactions between a player and the EGM are routed through a virtual mobile wallet account notwithstanding the virtual ticket interface converter module authenticates the financial transactions with the EGM as if the financial transactions were physically performed using the payment device and the payout device. In this way, all financial transfers to/from the EGM are handled via a ticketing system, however the tickets are quickly converted into, or created from, the player's cashless account. By combining the functionality of the ticketing system (which is generally compatible with third-party systems) with the mechanisms of the cashless wagering system, cashless wagers may be seamlessly integrated into many third-party providers and enhance the overall gaming experience for the player or patron.

Gaming Systems in a Gaming Environment

By way of background, but not by way of limitation, the following describes one or more representative computer and gaming environments in which the techniques of this disclosure (described below) may be practiced.

Turning now to FIG. 1, a block diagram illustrating a gaming system environment 100 is shown. Environment 100 includes a Gaming Terminal Data Repository (GTDR) connected via one or more network interface(s) to a gaming network which, for example, may include gaming devices (e.g., gaming terminals) and/or other devices, in which aspects of the present disclosure may be realized. As illustrated in FIG. 1, the gaming environment 100 may comprise a gaming system/environment 122 located in a physical environment (not shown). It will be appreciated that the communications link between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system. A gaming system/environment 122 may be located at least partially in one or more physical gaming environments, such as a casino, restaurant, and/or convenience store. For example, the casino may include publicly accessible game areas where certain of the gaming system devices 124, such as EGMs 125 and table games 127 are located, as well as secure areas where the servers and other components are located.

In one embodiment, the physical environment includes at least a portion of a physical structure, such as casino, housing one or more components of the gaming system/environment 122. The gaming system/environment 122 includes one or more gaming system devices 124 or components. The gaming system devices 124 may include EGMs 125, such as those known as video or slot machines. The devices 124 may also include "table" games 127 such as Blackjack and Roulette. The gaming devices 124 may also include components or devices such as player tracking card readers 129, coin counters and other gaming devices functionality options, which devices or components may be linked or associated with other devices. The devices or components may also comprise computers or servers and communication equipment, cashier and accounting workstations and a wide variety of other elements.

In one embodiment, the gaming system/environment 122 may include a variety of sub-systems. These sub-systems may be partially or fully independent of one another or may be related. In one embodiment, each system may be included or be part of a network. In one embodiment, the gaming system/environment 122 may include a game presentation/operation system, which includes at least one game server 126. The game server 126 may comprise a computing device including a processor and a memory. The game server 126 may be adapted to perform a variety of functions. This functionality may be implemented by software and/or hardware of the server 126. In one embodiment, the game server 126 may be arranged to provide information or instructions to the one or more gaming devices 124 or individual gaming system components. The information may comprise game code and control data. In one embodiment, the game server 126 may also be arranged to accept information from the gaming devices 124 or components. For example, the game server 126 may accept information regarding the status of operation of a particular gaming system device 124 (such as "normal" or "malfunction").

In one embodiment, the game server 126 is part of a network, which includes a communication link between the game server 126 and selected gaming system device(s) 124 and/or other component(s) with which communication is desired. A communication interface may be associated with the game server 126 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, Radio Frequency (RF), Infrared, etc. The communication links may transmit electrical, electromagnetic or optical signals, which carry digital data streams, or analog signals representing various types of information. In one embodiment, such as when the gaming device 124 comprises an EGM 125, the device 124 may include a master gaming controller, which controls the functions of game operation. The communication interface may be associated with the master gaming controller, permitting data to be transmitted between the game server 126 and the master gaming controller.

In one embodiment, the gaming system/environment 122 may include a player tracking system, which includes at least one player-tracking server 128. The player-tracking server 128 may also comprise a computing device including a processor and a memory. The player-tracking server 128 may be adapted to perform player-tracking functions. For example, the player-tracking server 128 may store information regarding the identities of players and information regarding the game play of those players. This information may include time of play, coin in/coin out or other monetary transaction data, and in an arrangement where players are awarded points based on play, a player's point total. Once again, the player tracking system includes a network comprising a communication link provided between the player tracking server 128 and one or more of the gaming devices 124 having a player tracking function or other components of the gaming system/environment 122 associated with the system. In one embodiment, such as where the gaming device 124 comprises an EGM, the device may include a management interface board, which controls a card reader. The management interface board may be arranged to receive data from the master gaming controller of the gaming system device 124. A communication interface is associated with the management interface board, permitting data to be transmitted between the player tracking server 128 and the management interface board.

In the case of table games, a card reader 129 may be associated with the table (e.g., the card reader located on or near the table game). Players may utilize the card reader to identify themselves. Information regarding play of the table game may be input through an input device by a dealer, coin counter or the like, and this information may be transmitted to the player tracking server 128.

In one embodiment, the gaming system/environment 122 may include an accounting system, which includes at least one accounting server 130. The accounting server 130 may comprise a computing device including a processor and a memory. The accounting server 130 is preferably adapted to perform financial related functions, such as track financial transactions such as bets and payouts, and perform reconciliations with monies collected from the gaming system devices 124, such as EGMs 125, table games 127. The accounting server 30 may be associated with a wide variety of devices, including individual gaming system devices 124 and other servers. Once again, a communication link may be provided between the accounting server 130 and each device with which communications is desired.

In one embodiment, the gaming system/environment 122 may include a progressive award system, which includes at least one progressive server 132. The progressive server 132 may comprise a computing device including a processor and a memory. The progressive server 132 may be designed to generate progressive award information. In one arrangement, the progressive server 132 may obtain information regarding amounts bet at specific gaming system devices 124, such as EGMs 125 or table games 127. Utilizing this information, a progressive jackpot award amount may be generated and updated using a specified protocol. The information may be transmitted to one or more displays 134 associated with participating devices 124. Once again, a communication link is preferably provided between the progressive server 132 and each device with which communications is desired. For example, a link may be provided between the progressive server 132 and accounting server 130 for providing payout information to the accounting server 130. The accounting server 130 also reads the paid amounts from the EGMs 125 as well and makes sure the paid amounts match what the progressive server claimed the paid amounts should have been. If the paid amounts do not match, then the accounting server 130 may raise a flag for further investigation by casino staff or regulators.

A physical and/or virtual information host 136 is associated with or comprises a portion of the gaming system/environment 122. In one embodiment, the host 136 comprises a computing device, which includes a processor, memory and a display. The virtual information host 136 may be one or more devices separate from devices performing other functions of the system/environment 122, or may be integrated with existing devices. The virtual information host 136 may be designed and adapted to perform functions relating to acquiring, managing, rendering, generating and/or displaying real-time and/or non real-time casino gaming system or "gaming environment" graphical information and information regarding one or more components of the gaming system or environment. Such functionality may also include the generation of at least one graphical user interface on at least one mobile device (e.g., 131), which is configured or designed to graphically display information (e.g., real-time casino information) relating to selected aspects of casino activity. Also, different graphical user interfaces may be displayed on an external application, such as on an application of a computer, smart phone, and/or on any type of mobile device 131. In one embodiment, bi-directional communication channels 121 are provided for direct, two-way communication between the host 136 and at least one game server 126 and at least one player-tracking server 128, and/or any other device with which communications is desired.

As illustrated in the example of FIG. 1, gaming system/environment 122 may also include one or more mobile devices 131 configured or designed to communicate, via one or more wireless links 111, with various components of the gaming environment 100 such as, for example: information systems (e.g., virtual information host 136); player tracking systems; accounting systems; employee management systems; location positioning systems (e.g., GPS system 133); game servers; surveillance systems; security systems; communications systems; gaming systems (e.g., EGMs 125, game table devices 127, other mobile devices 125, etc.); etc.

It should be noted that, during an actual implementation of the functionality disclosed herein, players may use the mobile devices 131 (which also may be referred to as Personal Electronic Devices (PEDs)) to initiate funding transfers, and the mobile devices 131 may use a variety of communication protocols such as near field communication (NFC), Bluetooth, and/or other wireless communications to transfer funds to and from the EGM. The funds of the player may come from any type of financial institution (e.g., a bank) or a player wagering account of one or more gaming venues, and the funds of the player may also be stored on the mobile devices 131 as a virtual ticket. In one embodiment, the wireless communication may communicate directly with the processing unit on a particular and identified EGM. The EGM may further be configured with a software and/or hardware device that communicates with the mobile devices 131. The EGM may contain a device that communicates with the payment acceptor (e.g., a bill acceptor or printer) to simulate bills and tickets. The EGM may have a device (software and/or hardware) that communicates with a back end host that ultimately uses slot account system (SAS) or game-to-system (G2S) to move the money to and from the particular and identified EGM. This configuration allows all of EGMs to be retrofitted for mobile payments.

Figure 2:
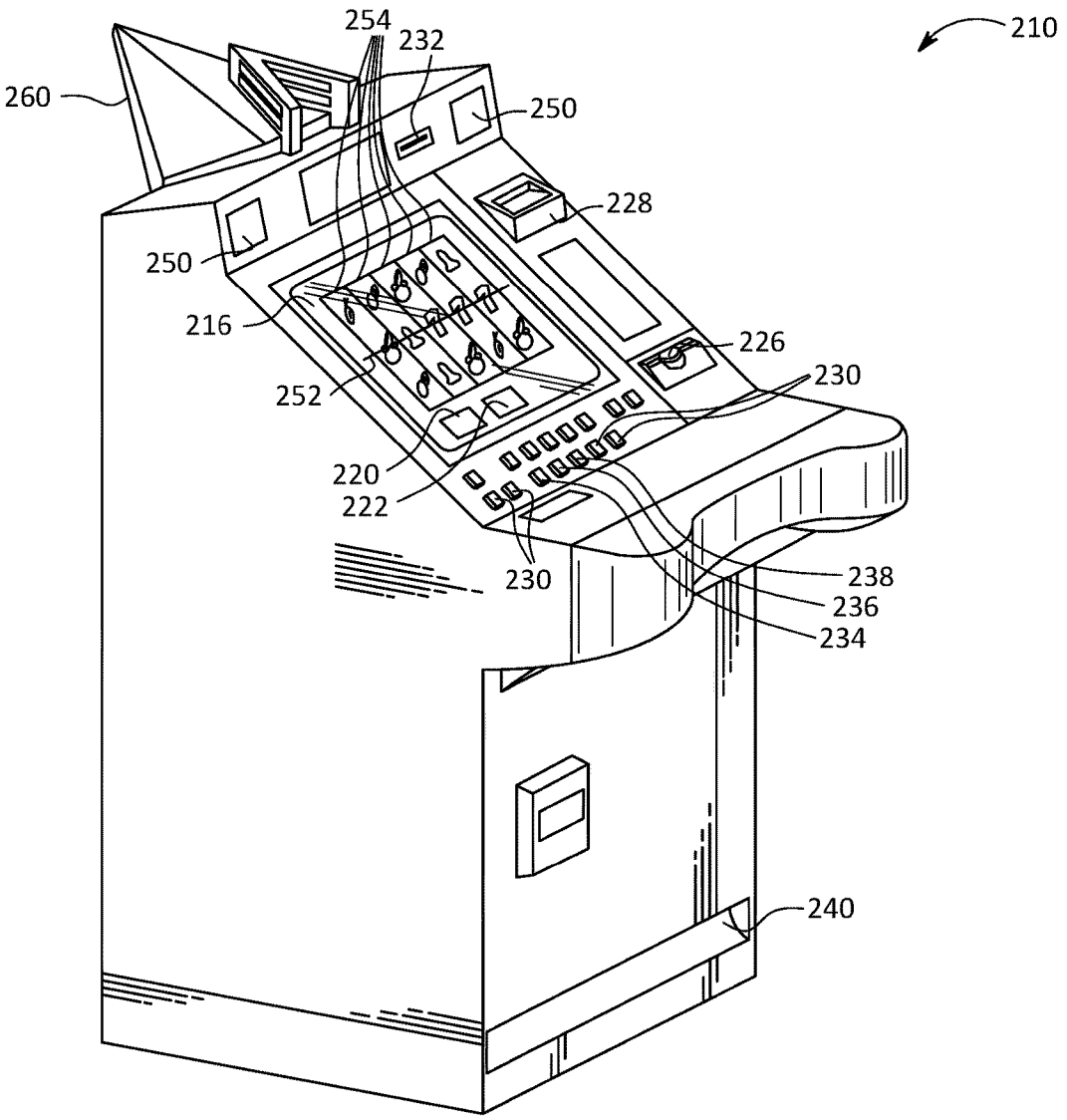
FIG. 2 is a perspective view of one embodiment of a slot machine or gaming device suitable for use in the gaming system of FIG. 1.

FIG. 2 is a perspective view of one embodiment 210 of a slot machine, EGM, or gaming device suitable for use in the previously depicted system of FIG. 1, in which aspects of the present disclosure may be realized. FIG. 2 represents a base gaming device 210 that can be employed in the shared display system or the gaming system of the present disclosure is illustrated as gaming device 210. FIG. 2 illustrates features common to each of the gaming devices. In one embodiment, gaming device 210 has a support structure, housing or cabinet, which provides support for a plurality of displays, inputs, controls and other features of a conventional EGM. In the illustrated embodiment, the player plays gaming device 210 while sitting, however, the gaming device is alternatively configured so that a player can operate it while standing or sitting. The illustrated gaming device 210 is positioned on the floor but can be positioned alternatively (i) on a base or stand, (ii) as a pub-style table-top game (e.g., where the participant gaming devices are located remotely from the shared wheel as discussed below), (iii) as a stand-alone gaming device on the floor of a casino with other stand-alone gaming devices, which the player operates while standing or sitting (e.g., where the participant gaming devices are located remotely from the shared wheel as discussed below), or (iv) in any other suitable manner. The gaming device 210 can be constructed with varying cabinet and display configurations. Also, referring to an embodiment for the electronic configuration of gaming device 210, each gaming device may include the components described below in FIG. 3A and FIG. 3B.

In one embodiment, each gaming device 210 randomly generates awards and/or other game outcomes based on probability data. That is, each award or other game outcome is associated with a probability and each gaming device generates the award or other game outcome to be provided to the player based on the associated probabilities. Since each gaming device 210 generates outcomes randomly or based upon a probability calculation, there is no certainty that the gaming device 210 will provide the player with any specific award or other game outcome.

In another embodiment, as discussed in more detail below, each gaming device 210 employs a predetermined or finite set or pool of awards, progressive awards, prizes or other game outcomes. As each award or other game outcome is provided to the player, the gaming device 210 removes the provided award or other game outcome from the predetermined set or pool. Once removed from the set or pool, the specific provided award or other game outcome cannot be provided to the player again. The gaming device 210 provides players with all of the available awards or other game outcomes over the course of the play cycle and guarantees a designated amount of actual wins and losses.

Figure 3A:
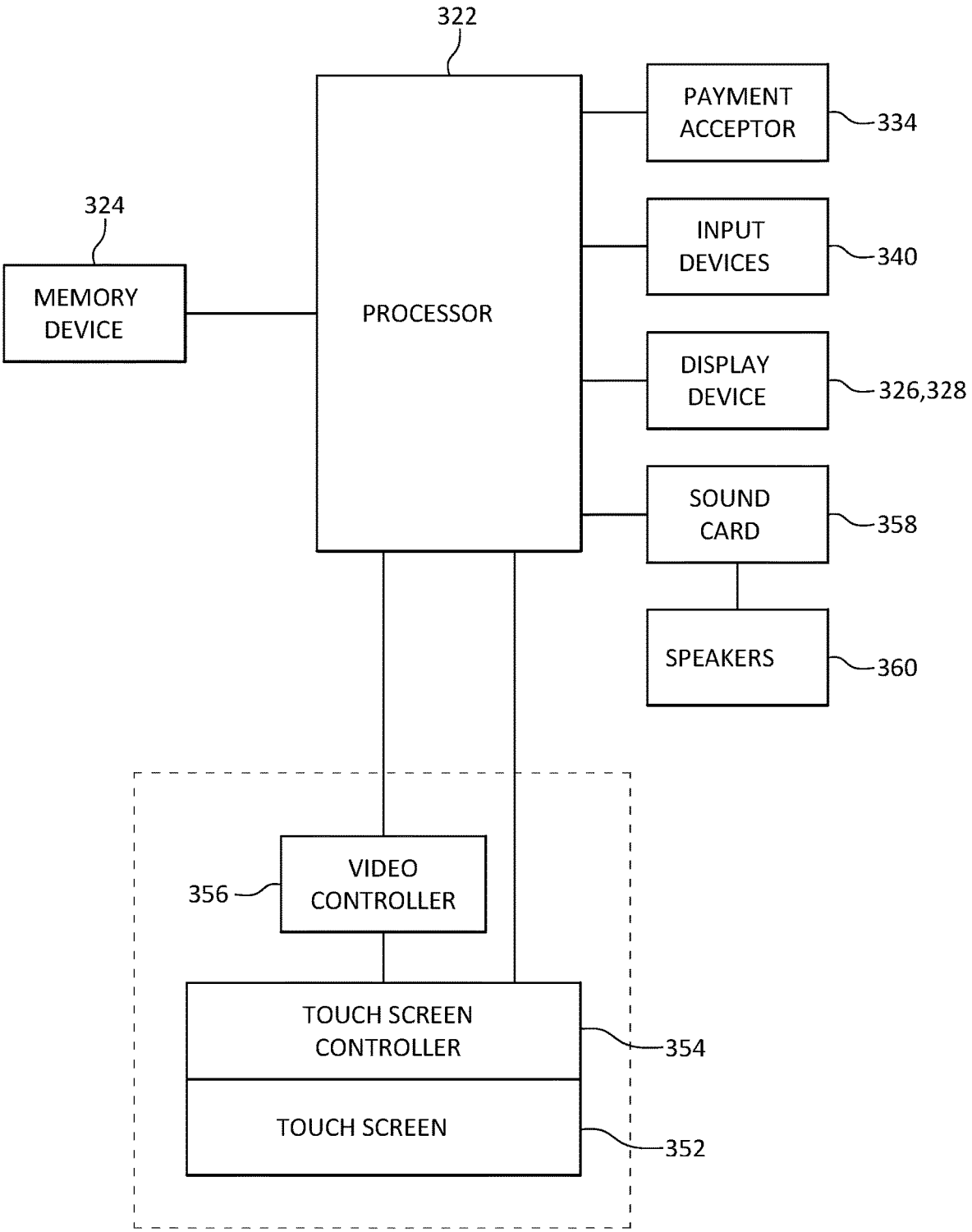
FIG. 3A is a block diagram illustrating an electronic configuration for use in the gaming device of FIG. 2.

As seen in FIG. 2, the gaming device 210 includes a credit display 220 that displays a player's current number of credits, cash, account balance or the equivalent. In one embodiment, gaming device 210 includes a bet display 222 that displays a player's amount wagered. As illustrated in FIG. 3A, in one embodiment, each gaming device 210 includes at least one payment acceptor 334 (FIG. 3A) that communicates with processor 322 (FIG. 3A).

As seen in FIG. 2, the payment acceptor 334 (FIG. 3A) in one embodiment includes a coin slot 226, where the player inserts coins or tokens, and a ticket, note or bill acceptor 228, where the player inserts a bar-coded ticket, note, or cash. In one embodiment, a player-tracking card, credit card, debit card or data card reader/validator 232 is also provided for accepting any of those or other types of cards.

In one embodiment, a player inserts an identification card into card reader 232 of gaming device 210. The identification card can be a smart card having a programmed microchip or a magnetic strip coded with a player's identification, credit totals and other relevant information. In one embodiment, money may be transferred to gaming device 10 through an electronic fund transfer and card reader 232 using the player's credit, debit or smart card. When a player funds gaming device 210, processor 322 (FIG. 3A) determines the amount of funds entered and the corresponding amount is shown on the credit or other suitable display as described above. In one embodiment, after appropriate funding of gaming device 210, the player presses a play button 234 or pull arm (not illustrated) to start any primary game or sequence of events. In one embodiment, upon appropriate funding, gaming device 210 begins game play automatically. In another embodiment, the player needs to actuate or activate one of the play buttons to initiate play of gaming device 210.

As shown in FIG. 2, a bet one button 236 is provided. The player places a bet by pushing bet one button 236. The player increases the player's wager by one credit each time the player pushes bet one button 236. When the player pushes the bet one button 236, the number of credits shown in the credit display 220 decreases by one, and the number of credits shown in the bet display 222 increases by one. A max bet max button (not shown) can also be provided, which enables the player to bet the maximum wager (e.g., max lines and max wager per line). Gaming device 210 may include other suitable wager buttons 230, such as a max bet button, a repeat bet button, one or more select paylines buttons and one or more select wager per payline buttons.

In one embodiment, a cash out button 238 is provided. The player presses cash out button 238 and cashes out to receive a cash payment or other suitable form of payment corresponding to the number of remaining credits. The player can receive coins or tokens in a coin payout tray 240 or a ticket or credit slip, which are redeemable by a cashier or funded to the player's electronically recordable identification card. Each gaming device 210 also includes one or a plurality of communication ports for enabling communication of a processor with one or more external peripherals, such as external video sources, expansion buses, expansion games or other displays, an SCSI port or a key pad.

In one embodiment of FIG. 2, in combination with in FIG. 3A, a touch-screen 352 (FIG. 3A) is provided in one embodiment and operates with a touch-screen controller 354, processor 322 (FIG. 3A) and display device 326,328 (FIG. 3A). Touch-screen 352 (FIG. 3A) and the touch-screen controller 354 are also connected to a video controller 356. The player touches touch-screen 352 at appropriate places to input decisions and signals into processor 322 of gaming device 210. Also, each gaming device 210 may include a sound generating device controlled by one or more sounds cards 258, which function in conjunction with processor 322 (FIG. 3A). In one embodiment, the sound generating device includes at least one speaker 250 or other sound generating hardware and/or software for generating sounds, such as playing music for the primary and/or secondary game or for other modes of the gaming device, such as an attract mode. In one embodiment, each gaming device 210 provides dynamic sounds coupled with attractive multimedia images displayed on display device 216 to provide an audio-visual representation or to otherwise display full-motion video with sound to attract players to gaming device 210. During idle periods, the gaming device 210 displays a sequence of audio and/or visual attraction messages to attract potential players to gaming device 210.

In one embodiment, gaming device 210 includes a camera in communication with a processor, which is positioned to acquire an image of a player playing gaming device 10 and/or the surrounding area of gaming device 10. In one embodiment, the camera may be configured to selectively acquire still or moving (e.g., video) images and may be configured to acquire the images in either an analog, digital or other suitable format. Display device 216 may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, as illustrated in FIG. 2, a base or primary game includes a slot game with one or more paylines 252. Paylines 252 may be horizontal, vertical, circular, diagonal, angled or any combination thereof. For a slot game, gaming device 210 displays at least one reel and preferably a plurality of reels 254, such as three to five reels, in either electromechanical form with mechanical rotating reels or in video form with simulated reels and movement thereof. Each reel 254 displays a plurality of indicia such as bells, hearts, fruits, numbers, letters, bars or other images, which preferably correspond to a theme associated with the gaming device. With a slot game, gaming device 10 awards prizes when reels 254 stop spinning and display a winning or paying symbol or combination of symbols on an active payline 252.

In one embodiment, each gaming device 210 includes indicators 260. Indicators 260 reside on the top of each gaming device 10 and point to or indicate one of the awards or outcomes on top of shared display (not shown) when the shared display stops spinning to reveal randomly or otherwise generated results or outcomes. Indicators 260 may illuminate differently at different times or states for the gaming device 210. The illumination of the indicator 260 in one embodiment depends upon whether the gaming device 210 is playing a base game, is in a state in which the player is eligible to play the shared display bonus, is in a state in which the player has committed to play the shared display bonus or is in a state in which the player has declined to play a particular upcoming shared display bonus, as well as other states discussed below.

FIG. 3A is a block diagram illustrating an electronic configuration for use in the gaming device of FIG. 2, here again in which aspects of the present disclosure may be realized. In the embodiment illustrated in FIG. 3A the player station may include at least one processor 322, such as a microprocessor, a microcontroller-based platform, a suitable integrated circuit or one or more ASICs. The processor 322 is in communication with or operable to access or to exchange signals with at least one data storage or memory device 324. In one embodiment, the processor 322 and the memory device 324 reside within the cabinet of the player station. The memory device 324 stores program code and instructions, executable by the processor 322, to control the player station. The memory device 324 also stores other data such as image data, event data, player input data, random or pseudo-random number generators, pay-table data or information and applicable game rules that relate to the play of the player station. In one embodiment, the memory device 324 includes random access memory (RAM), which can include non-volatile RAM (NVRAM), magnetic RAM (MRAM), ferroelectric RAM (FeRAM) and other forms as commonly understood in the gaming industry. In one embodiment, the memory device 324 includes read only memory (ROM). In one embodiment, the memory device 324 includes flash memory and/or EEPROM. Any other suitable magnetic, optical and/or semiconductor memory may operate in conjunction with the player station and gaming system disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming system is operable over a wireless network, such as part of a wireless gaming system. In this embodiment, the player station may be a hand held device, a mobile device or any other suitable wireless device that enables a player to play any suitable game at a variety of different locations. It should be appreciated that a player station as disclosed herein may be a device (e.g., EGM) that has obtained approval from a regulatory gaming commission or a device that has not obtained approval from a regulatory gaming commission. It should be appreciated that the processor and memory device may be collectively referred to herein as a "computer" or "controller."

In one embodiment, as mentioned above and seen in FIG. 3A, one input device is a touch-screen 352 coupled with a touch-screen controller 354, or some other touch-sensitive display overlay to allow for player interaction with the images on the display. The touch-screen and the touch-screen controller are connected to a video controller 356. A player can make decisions and input signals into the player station by touching the touch-screen at the appropriate places. One such input device is a conventional touch-screen button panel. In another embodiment, a plurality or each of the display segments is a touch-screen 352 coupled with a touch-screen controller 354 or some other touch-sensitive display overlay to allow for player interaction with the images on the display segments. The touch-screens 352 and the touch-screen controllers 354 are connected to a video controller. The player station may further include a plurality of communication ports for enabling communication of the processor with external peripherals, such as external video sources, expansion buses, game or other displays, an SCSI port or a key pad. In one embodiment, at least one payment acceptor 324 that communicates with processor 322 for playing a bet, input devices 340, and display devices 326, 328 are provided.

The player stations, the central controller and the display segments may include serial interfaces and/or Ethernet (e.g., the G2S protocol uses commodity Ethernet equipment and TCP/IP) to connect to specific subsystems or subnets internal and external to the player stations, central controller and the display segments. The serial devices may have electrical interface requirements that differ from the "standard" EIA serial interfaces provided by general-purpose computers. These interfaces may include EIA, EIA, Fiber Optic Serial, optically coupled serial interfaces, current loop style serial interfaces, etc. In addition, to conserve serial interfaces internally in the player station, serial devices may be connected in a shared, daisy-chain fashion where multiple peripheral devices are connected to a single serial channel.

The serial interfaces and/or Ethernet may be used to transmit information using communication protocols that are unique to the gaming industry. For example, SAS is a communication protocol used to transmit information, such as metering information, from a player station to a remote device. Often SAS is used in conjunction with a player tracking system. EGMs may be treated as peripheral devices to a casino communication controller and connected in a shared daisy chain fashion to a single serial interface and/or Ethernet. In both cases, the peripheral devices are preferably assigned device addresses. If so, the serial controller circuitry must implement a method to generate or detect unique device addresses. In one embodiment, security-monitoring circuits detect intrusion into a player station or gaming station by monitoring security switches attached to access doors in a designated area, such as a player station cabinet. In one embodiment, access violations result in suspension of game play and can trigger additional security operations to preserve the current state of game play. These circuits also function when power is off by use of a battery backup. In one embodiment, as seen in FIG. 3A, the player station includes a sound generating device controlled by one or more sounds cards 358 which function in conjunction with the processor. In one embodiment, the sound generating device includes at least one and preferably a plurality of speakers 360 or other sound generating hardware and/or software for generating sounds, such as playing music for the primary and/or secondary game or for other modes of the player station, such as an attract mode. In one embodiment, the player station provides dynamic sounds coupled with attractive multimedia images displayed on one or more of the display devices to provide an audio-visual representation or to otherwise display full-motion video with sound to attract players to the player station. During idle periods, the player station may display a sequence of audio and/or visual attraction messages to attract potential players to the player station. The videos may also be customized for or to provide any appropriate information.

Figure 3B:
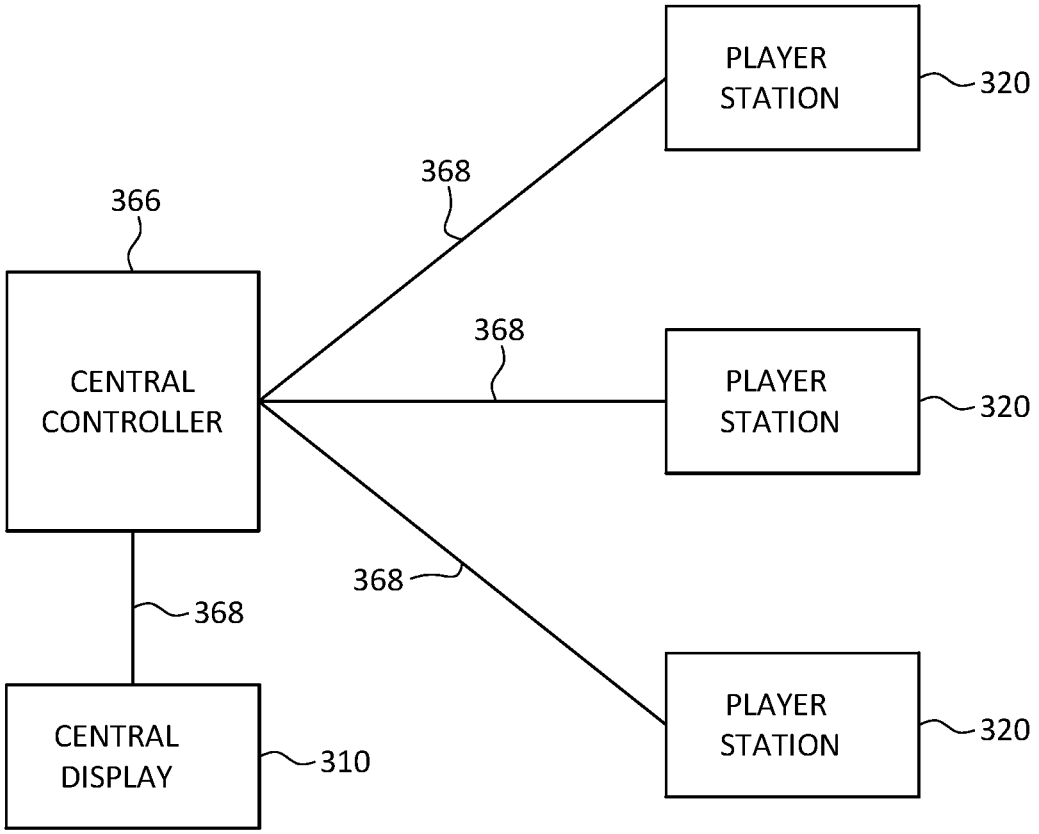
FIG. 3B is a block diagram illustrating player stations in communication with a central controller and a central display in communication with the central controller for use in the gaming device of FIG. 2.

FIG. 3B is a block diagram illustrating a player station 320 in communication with a central controller and a central display 310 in communication with the central controller for use in the gaming device of FIG. 2, in which aspects of the present disclosure may be realized. In one embodiment, as illustrated in FIG. 3B, one or more of the player stations 320 are in communication with each other and/or at least one central server, central controller or remote host 366 through a data network or remote communication link 368. The central server, central controller or remote host is any suitable server or computing device, which includes at least one processor and at least one memory or storage device, and may also be in communication with a central display 310. In other embodiments, the central server is a progressive controller or a processor of one of the player stations in the gaming system. In these embodiments, the processor of each player station is configured to transmit and receive events, messages, commands, a current progressive value or any other suitable data or signal between the individual player station and the central server. The player station processor is operable to execute such communicated events, messages or commands in conjunction with the operation of the player station. Moreover, the processor of the central server is configured to transmit and receive events, messages, commands or any other suitable data or signal between the central server and each of the individual player stations. The central server processor is operable to execute such communicated events, messages or commands in conjunction with the operation of the central server. It should be appreciated that one or more of each of the functions of the central controller may be performed by one or more player station processors. It should be further appreciated that one, more or each of the functions of one or more player station processors as disclosed herein may be performed by the central controller. In one embodiment, the central controller has an Uninterruptible Power Supply ("UPS"). In one embodiment, the UPS is a rack mounted UPS module.

In one embodiment, the player stations disclosed herein are associated with or otherwise integrated with one or more player tracking systems. In this embodiment, the player station and/or player tracking system tracks players gaming activity at the player station. In one such embodiment, the player station and/or associated player tracking system timely tracks when a player inserts their playing tracking card to begin a gaming session and also timely tracks when a player removes their player tracking card when concluding play for that gaming session. In another embodiment, rather than requiring a player to insert a player-tracking card, the player station utilizes one or more portable devices carried by a player, such as a cell phone, a radio frequency identification tag or any other suitable wireless device to track when a player begins and ends a gaming session. In another embodiment, the player station utilizes any suitable biometric technology or ticket technology to track when a player begins and ends a gaming session. During one or more gaming sessions, the player station and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. The player stations are capable of being connected together through a data network. In one embodiment, the data network is a local area network (LAN), in which one or more of the player stations are substantially proximate to each other and an on-site central server or controller as in, for example, a gaming establishment or a portion of a gaming establishment. In another embodiment, the data network is a wide area network (WAN) in which one or more of the player stations are in communication with at least one off-site central server or controller. The player stations may be located in a different part of the gaming establishment or within a different gaming establishment than the off-site central server or controller. Thus, the WAN may include an off-site central server or controller and an off-site player station located within gaming establishments in the same geographic area, such as a city or state. The WAN gaming system may be substantially identical to the LAN gaming system described above, although the number of player stations in each system may vary relative to each other.

In one embodiment, as a benefit to one or more of the gaming venues (e.g., a casino), using the player tracking system, along with use of the GPS positioning, for identifying the movements of the players throughout the gaming venues, identifying cash, money, credits, and award amounts spent along with various trends (e.g., historical) for generating visual graphs while displaying showing top view of the gaming venue (e.g., looking down from above the gaming venue) to improve casino layouts and identify patterns and movements of all types of players.

In another embodiment, the data network is an Internet or intranet. The operation of the player station can be viewed at the player station with at least one Internet browser. Operation of the player station and accumulation of credits may be accomplished with only a connection to the central server or controller (the internet/intranet server) through a conventional phone or other data transmission line, digital subscriber line (DSL), T-I line, coaxial cable, fiber optic cable, WIFI, or other suitable connection. Players may access an Internet game page from any location where an Internet connection and computer, or other Internet facilitator is available. The expansion in the number of computers and number and speed of Internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, the gaming system is in communication with a central server or controller. The central server or controller may be any suitable server or computing device, which includes at least one processor and a memory or storage device. In alternative embodiments, the central server is a progressive controller or another player station in the gaming system. In one embodiment, the memory device stores different game programs and instructions, executable by a player station processor, to control the player station. Each executable game program represents a different game or type of game, which may be played on one or more of the player stations in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the player station) or vice versa.

In this embodiment, one, all or a plurality of the player stations at least includes one or more display devices and/or one or more input devices for interaction with a player. A local processor, such as the above-described player station processor or a processor of a local server, is operable with the display device(s) and/or the input device(s) of one or more of the player stations. In operation, the central controller is operable to communicate one or more of the stored game programs to at least one local processor. In different embodiments, the stored game programs are communicated or delivered by embedding the communicated game program in a device or a component (e.g., a "chip" to be inserted in a player station), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the player station. That is, when a game program is communicated to a local processor, the local processor changes the game or type of game played at the player station or displayed on the display segment. Though the illustrated embodiments are described with the central controller determining a game result for the player and communicating that result to the central display 310 and one or more player stations, any other suitable game determining method may be employed in any embodiment of the present disclosure. In one embodiment, the central display 310 is associated with a central display 310 server. This central display 310 server determines the game outcome for the games played on each of the display segments. The central display 310 server communicates the game outcome to the central controller, which communicates the game outcome to one or more of the player stations.

As previously mentioned, in the gaming industry, many different manufacturers make EGMs and player stations. The communication protocols on the player station may be hard-wired into the player station and each player station/EGM manufacturer may utilize a different proprietary communication protocol. A player station manufacturer may also produce host systems, in which case their player stations are compatible with their own host systems. However, in a heterogeneous gaming environment, player stations from different manufacturers, each with its own communication protocol, may be connected to host systems from other manufacturers, each with another communication protocol. Therefore, communication compatibility issues regarding the protocols used by the player stations in the system and protocols used by the host systems must be considered.

Figure 4:
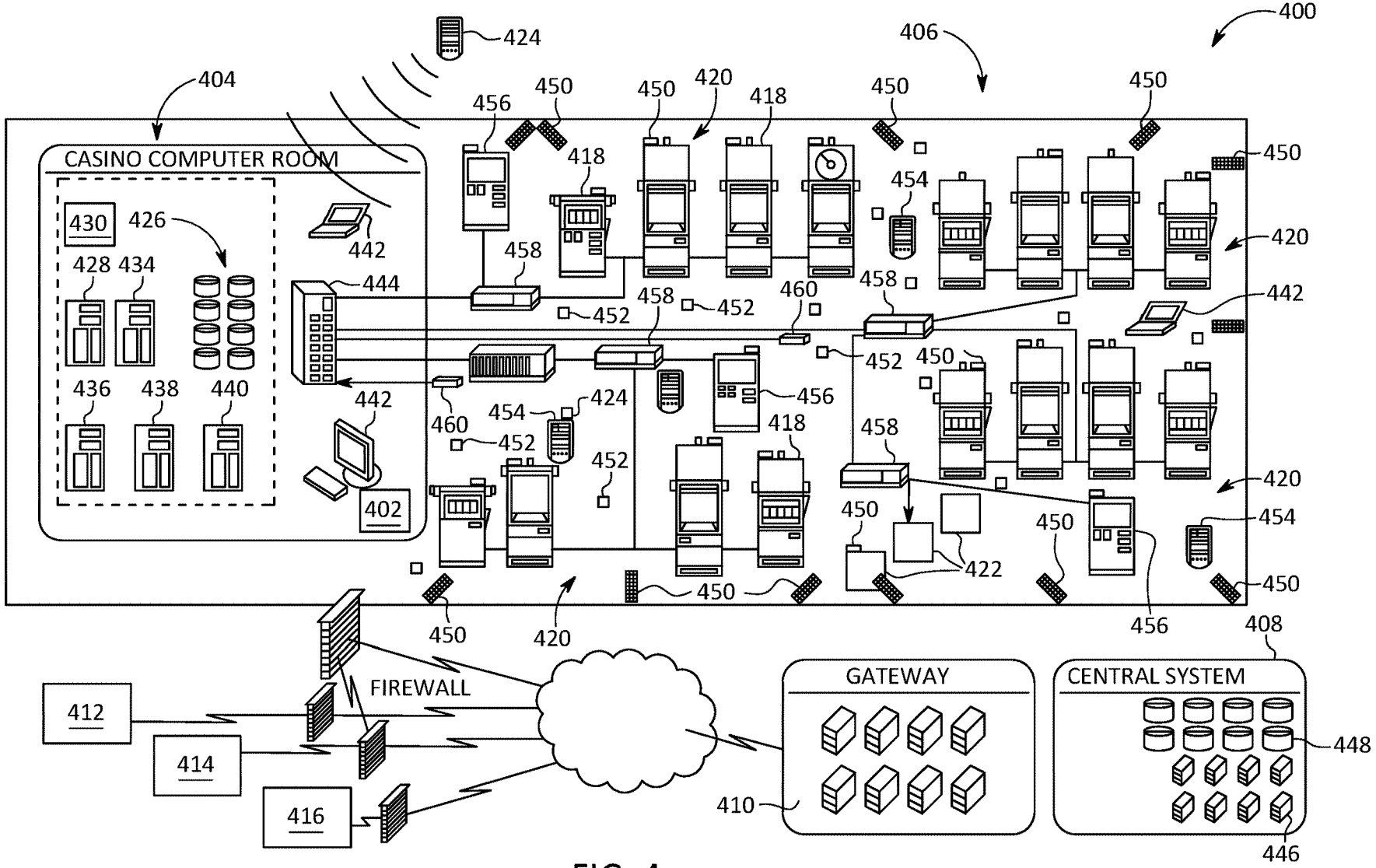
FIG. 4 is a schematic block diagram of a server-based gaming network.

FIG. 4 is a schematic block diagram of a server-based gaming network 400 in accordance with an exemplary embodiment of the present disclosure. In the exemplary embodiment, network 400 includes a slot floor mix recommendation system 402 incorporated therein. In one embodiment, slot floor mix recommendation system 402 is a stand-alone system communicatively coupled to network 400. In various embodiments, slot floor mix recommendation system 402 is incorporated within various components of network 400. Network 400 provides methods and devices for managing one or more networked gaming establishments. Network 400 may be embodied in what is known as a server-based gaming network, sbX™ network. For example, in one embodiment, a host may be included in the network, such as a server-based gaming network. For example, a gaming server (e.g., an sbX™ server) may be an example of the host. The gaming server (e.g., the sbX™ server) may be a set of servers running central applications and may attach as the host to EGMs via the gaming network. In one embodiment, a host, operating in the gaming network, may be a server (e.g., an sbX™ server) managing and controlling the gaming network (e.g., an sbX™ network). In one embodiment, the host, operating in the gaming network, may monitor the monetary activity of the EGM. The host may track any error conditions on the EGM. The host may configure the EGM such as to enable/disable games, download games, and configure game parameters (denomination, payback, etc.). For example, a gaming management solution (e.g., IGT® sbX™ gaming management solution) may be a server-based system to act as a repository for all game content that may be downloaded to EGMs giving each EGM instant access to the technology within the EGM's environment. The game software, random number generator and game logic are controlled by the EGM. This significantly increases configuration speed so that games may be adapted and seamlessly integrate analytics to the database in minutes. Game titles are accessed from the server using a floor manager (e.g., IGT Floor Manager®), running on the host, and allow operators to reconfigure their gaming floor almost instantly.

In one embodiment, the sbX™ application and its integrated modules provide for data analysis and also focus on player experience thereby allowing for the development of innovative marketing programs. For example, in one embodiment, certain banks of machines may be adapted to a featured game, linked to a proprietary progressive jackpot and then heavily promoted during certain times. Thus, these games may become a favorite and preferred EGM during a particular time. Following the promotion, the EGMs can quickly be restored to their original games. In one embodiment, the sbX™ system may be driven by IGT's Advanced Video Platform (AVP®) with the technology seamlessly integrated with all modules, permitting fast connectivity and advanced capabilities. In addition, GSA open protocols are used so that sbX™ applications are interoperable with third-party devices that have also adopted GSA open protocols.

Thus, in one embodiment, if a demand for a particular type of the EGM is in high demand (e.g., multiple users are selecting a favorite and/or preferred game on a particular EGM) but the supply of the favorite and/or preferred game on a particular EGM is low, the floor manager application provides the ability to quickly (e.g., within minutes) update and replace the EGMs having low performing games and/or non-preferred games on the EGM with the higher performing and/or favorite and preferred game on a particular EGM.

In one embodiment, network 400 permits the convenient provisioning of networked gaming machines and other devices relevant to casino operations. Game themes may be easily and conveniently added or changed, if desired. Related software, including but not limited to player tracking software and peripheral software may be downloaded to networked gaming machines, mobile gaming devices, thin clients and/or other devices, such as kiosks, networked gaming tables, player stations.

In the exemplary embodiment, network 400 includes a casino computer room 404 and networked devices of a gaming establishment 406. Gaming establishment 406 is configured for communication with a central system 408 via a gateway 410. Other gaming establishments 412, 414, and 416 are also configured for communication with central system 408.

Gaming establishment 406 includes multiple gaming machines 418. Some of gaming machines 418 form a cluster or "bank" 420 of gaming machines 418. Gaming machines 418 are configured for communication with one or more devices of casino computer room 404 or similar devices disposed elsewhere in gaming establishment 406. Some of gaming machines 418 may be configured to read from, and/or write information to, a portable instrument such as but not limited to, a ticket and a player loyalty device. In one embodiment, gaming establishment 406 also includes a bank of networked gaming tables 422. However, network 400 may be implemented in gaming establishments having any number of gaming machines, gaming tables, etc. It will be appreciated that many gaming establishments 406 include hundreds or even thousands of gaming machines 418, gaming tables 422 and/or mobile devices 424, not all of which are necessarily associated bank 420 and some of which may not be connected to network 400. At least some of gaming machines 418 and/or mobile devices 424 may be "thin clients" that are configured to operate, at least in part, according to instructions from another device (such as a server).

Multiple storage devices 426, sbX™ server 428, License Manager 430, servers 434, 436, 438, and 440, host device(s) 442, and main network device 444 are disposed within computer room 404 of gaming establishment 406. In practice, more or fewer devices may be used. Depending on the implementation, some such devices may reside elsewhere in gaming establishment 406.

One or more of the devices in computer room 404 (or similar devices disposed elsewhere in gaming establishment 406 or in gaming establishment 412, 414, or 416) may be configured to provide functionality relevant to embodiments of the present disclosure. For example, one or more of servers 434, 436, 438, or 440 may be configured for communication with gaming machines 418 that are configured to provide a subset of themes for selection by a player. For example, one or more such servers may be configured to provide a selection of a subset of four themes from a large number of available themes.

Accordingly, in some embodiments at least some gaming establishments may be configured for communication with one another. In this example, gaming establishments 412, 414, and 416 are configured for communication with casino computer room 404. Such a configuration may allow devices and/or operators in casino 406 to communicate with and/or control devices in other casinos. In some such implementations, a server (or another device) in computer room 404 may be configured to communicate with and/or control devices in gaming establishments 412, 414, and 416. Conversely, devices and/or operators in another gaming establishment may communicate with and/or control devices in casino 406.

Some of these servers in computer room 404 may be configured to perform tasks relating to accounting, player loyalty, bonusing/progressives, configuration of gaming machines, etc. A Radius server and/or a DHCP server may also be configured for communication with the gaming network. In various embodiments, sbX™ server 428 and the other servers shown in FIG. 4 include or are in communication with clustered CPUs, redundant storage devices, including backup storage devices, switches, etc. Such storage devices may include a redundant array of independent disks (RAID) array, back-up hard drives and/or tape drives, etc.

In various embodiments, many of these devices (including but not limited to License Manager 430, servers 434, 436, 438, and 440, and main network device 444) are mounted in a single rack with sbX™ server 428. Accordingly, many or all such devices will sometimes be referenced in the aggregate as an "sbX™ server." However, in alternative implementations, one or more of these devices is in communication with sbX™ server 428 and/or other devices of the network but located elsewhere. For example, some of the devices could be mounted in separate racks within computer room 404 or located elsewhere on the network. Moreover, in some implementations large volumes of data may be stored elsewhere, e.g., via a storage area network ("SAN").

Computer room 404 may include one or more operator consoles or other host devices that are configured for communication with other devices within and outside of computer room 404. Such host devices may be provided with software, hardware and/or firmware for implementing functions described herein. However, such host devices need not be located within computer room 404. Wired host devices 442 (which are desktop and laptop computers in this example) and wireless devices 424 (which are PDAs in this example) may be located elsewhere in gaming establishment 406 or at a remote location.

Some embodiments include devices for implementing access control, security and/or other functions relating to the communication between different devices on the network. One or more devices in central system 408 may also be configured to perform, at least in part, tasks specific to embodiments of the present disclosure. For example, one or more servers 446, storage devices and/or host devices 442 of central system 408 may be configured to implement the functions described in detail elsewhere herein. One or more servers 446, storage devices 448 and/or host devices 442 of central system 408 may maintain player account information.

Some gaming networks 400 provide features for gaming tables that are similar to those provided for gaming machines, including but not limited to bonusing, player loyalty/player tracking, the use of cashless instruments, etc. Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras 450, radio frequency identification devices 452 and 454, etc., may be used to identify and/or track patrons, playing cards, chips, etc. Some of gaming tables 422 may be configured for communication with individual player terminals (not shown), which may be configured to accept bets, present an electronic representation of a dealer, indicate game outcomes, etc.

Moreover, some such automated gaming tables 422 and/or associated player terminals may include, or may be configured for communication with, a device that includes a coin-out meter, a ticket reader, a card reader, a ticket printer, and/or other related features. In some implementations, one such device may provide such functionality to a plurality of automated gaming tables 422 and/or associated player terminals.

Gaming establishment 406 also includes networked kiosks 456. Kiosks 456 may include card readers, ticket readers, printers, a user interface system, one or more displays, etc. Depending on the implementation, kiosks 456 may be used for various purposes, including but not limited to cashing out, prize redemption, redeeming points from a player loyalty program, redeeming "cashless" indicia such as bonus tickets, smart cards, etc.

Kiosks 456 may be configured to read information from, and/or write information to, a portable instrument such as a smart card, a ticket, a card having a magnetic strip, etc. The corresponding gaming devices are preferably configured for communication with such kiosks 456 and vice versa. Accordingly, some such kiosks 456 may include a wireless interface that is configured for communication with mobile gaming devices 424.

In the exemplary embodiment, each bank 420 has a corresponding switch 458. Each switch 458 is configured for communication with one or more devices in computer room 404 via main network device 444, which combines switching and routing functionality in this example. Although various communication protocols may be used, some preferred implementations use the Gaming Standards Association's G2S Message Protocol. Some systems may use a gaming-industry-specific transport layer called CASH™, which offers additional functionality and security.

Gaming establishment 406 may also include an RFID network, implemented in part by RFID switches 460 and multiple RFID readers 452. An RFID network may be used, for example, to track objects such as mobile gaming devices 424, which include RFID tags 454, patrons, chips, player loyalty devices, etc., in the vicinity of gaming establishment 406.

Various alternative network topologies can be used to implement different aspects of the disclosure and/or to accommodate varying numbers of networked devices. For example, some gaming establishments may include cameras 450 for implementing advanced player tracking, player navigation or other functionality. Gaming establishments with large numbers of gaming machines 418 may require multiple instances of some network devices (e.g., of main network device 444, which combines switching and routing functionality in this example) and/or the inclusion of other network devices not shown in FIG. 4. Some embodiments may include one or more middleware servers disposed between kiosks 456, RFID switches 460 and/or bank switches 458 and one or more devices (e.g., a corresponding server, router or other network device) in computer room 404. Such middleware servers can provide various useful functions, including but not limited to the filtering and/or aggregation of data received from switches, from individual gaming machines and from other devices. Some implementations of the disclosure include load-balancing methods and devices for otherwise managing network traffic.

In one embodiment, using the embodiments described herein, a PED and/or other type of an external application (e.g., mobile application, web application, and the like) may be used to transfer money to and from the EGM employing a service window application, and the PED may use a variety of communication protocols such as near field communication (NFC), Bluetooth or other wireless communications to transfer money to and from the EGM, particularly using the information window (e.g., a service window) of the EGM, which may be operated by and/or in communication with an sbX™ server 428, central system 408, servers 446, a main network device 444, storage devices and/or host devices 442 of central system 408 may be configured to implement the functions described in detail elsewhere herein) and/or via the external application. The money of a player may come from any type of financial institution (e.g., a bank) or a player wagering account of a gaming venue. In one embodiment, the wireless communication may go directly to the processing unit on a particular and identified EGM being in communication with and/or controlled by a sbX™ server 428, central system 408, servers 446, a main network device 444, storage devices and/or host devices 442 of central system 408 may be configured to implement the functions described in detail elsewhere herein. The EGM may be configured with a hardware device that communicates with the PED. The EGM, using a service window application, may contain a device that communicates with a payment acceptor (e.g., a physical media, coin, and/or bill acceptor) or printer to simulate bills and tickets. The EGM may have a device (software and/or hardware) that communicates with a back end host that ultimately uses SAS or G2S to move the money to and from the particular and identified EGM. This configuration allows all of EGMs to be retrofitted for mobile payments.

In one embodiment, when an actual wireless mobile payment transfer can occur via a mobile device, money can be electronically moved virtually, along with the associated unique mobile device identifier tied to a players account and/or gaming event on the EGM, from an identified and/or a preferred EGM employing the service window application to the PED or vice versa. The service window application of the EGM can request the mobile device identifier from either the mobile device itself or request the mobile device identifier from the sbX™ server 428, the central system 408, servers 446, the main network device 444, storage devices and/or host devices 442 of central system 408 to implement the present disclosure described herein in order to prevent mobile payment transfers between mobile devices that do not have the associated unique mobile device identifier originally and an EGM, sbX™ server 428, the central system 408, servers 446, the main network device 444, storage devices and/or host devices 442 of central system 408.

In one embodiment, the EGM can employ the service window application in communication with the sbX™ server 428, the central system 408, servers 446, the main network device 444, storage devices and/or host devices 442 of central system 408 to facilitate mobile transfers of mobile payments in a gaming system. The service window of the EGM can receive, from the mobile device, a cash out request to receive winnings resulting from one or more game wins of an event, wherein the event is a gaming event resulting from the placement of the one or more wagers at the EGM. The EGM can request, via a service window application of the EGM, from the mobile device and/or sbX™ server 428, the central system 408, servers 446, the main network device 444, storage devices and/or host devices 442 of central system 408 in the gaming system, a mobile device identification (ID) assigned to the mobile device and associated with the player account ID of a player's account. The player's account ID is associated with the event and the host device stores each mobile device ID assigned for each of a plurality of mobile devices. The service window application of the EGM can receive the mobile device ID from both the mobile device and/or the sbX™ server 428, the central system 408, servers 446, the main network device 444, storage devices and/or host devices 442 of central system 408. The service window application EGM can verify the mobile device ID received from the mobile device and/or the sbX™ server 428, the central system 408, servers 446, the main network device 444, storage devices and/or host devices 442 of central system 408 are identical and associated with the player's account ID currently logged into the EGM in order to approve and transfer the winnings resulting from one or more game wins of the event to the mobile device. The service window of the EGM can electronically transfer, to the mobile device, a mobile payment of the winnings resulting from the one or more game wins of the gaming session and/or gaming event after verifying the mobile device ID using the sbX™ server 428, the central system 408, servers 446, the main network device 444, storage devices and/or host devices 442 of central system 408, which can be in communication with the mobile device.

Cashless Gaming Through Virtual Ticketing

Having described one or more gaming establishments and/or EGM architectures, as aforementioned, the present disclosure provides technology to integrate third-party casino management systems and cashless wagering systems by the use of virtual ticketing. The described virtual ticket interface converter module (or more simply, "virtual ticket converter"), may, in one embodiment, intercept communications between an input device (such as a card reader), a payment device (such as a bill acceptor/validator), and a payout device (such as a ticket printer) of the EGM such that financial transactions between a player and the EGM are routed through a virtual mobile wallet account notwithstanding the virtual ticket interface converter module authenticates the financial transactions with the EGM as if the financial transactions were physically performed using the payment device and the payout device. In this way, all financial transfers to/from the EGM are handled via a ticketing system, however the tickets are quickly converted into, or created from, the player's cashless account.

Figure 5:
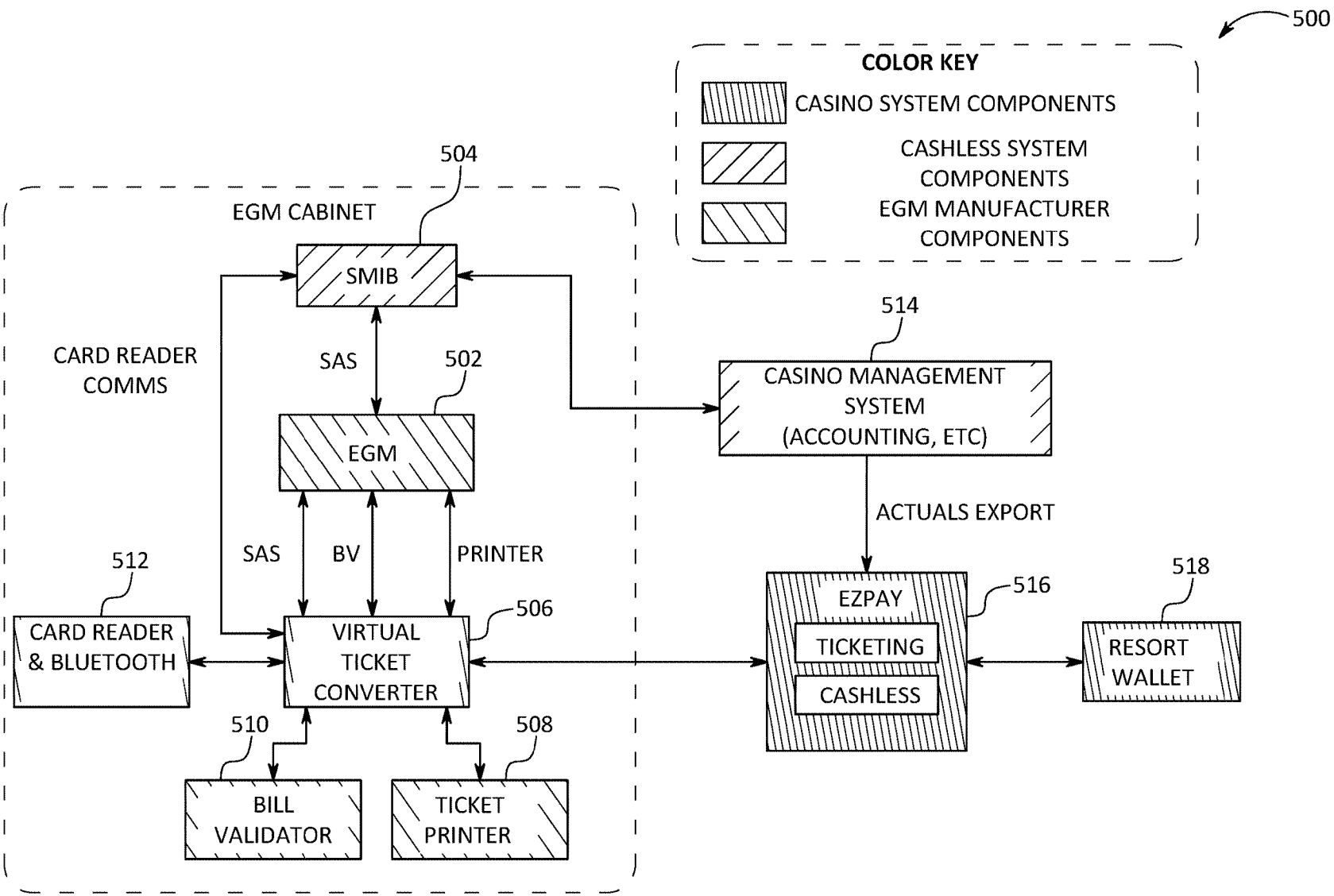
FIG. 5 is a schematic block diagram of a virtual ticketing system architecture in a gaming network.

Turning now to FIG. 5, FIG. 5 is a schematic block diagram of a virtual ticketing system architecture 500 in a gaming network. An EGM 502 is depicted as having incorporated a virtual ticket converter 506. The virtual ticket converter 506 is installed as a slot machine interface board (SMIB) 504 in the EGM 502, and communicates to a logic system (processor, memory, etc.) of the EGM 502 using a slot machine communications protocol for ticketing and event traffic. Typically, this communications protocol comprises SAS and runs on a second SAS channel exposed by the EGM 502. The virtual ticket converter 506 intercepts communications from a physical ticket printer 508 and a bill validator 510 of the EGM 502, while also being in communication a card reader and Bluetooth module 512 of the EGM 502. In other words, the virtual ticket converter 506 is able to detect, via the communications interceptions, whether a player has inserted a physical ticket or bill into the bill validator 510 of the EGM 502, and moreover, if the player has established a player session by the insertion of a card (e.g., a gaming establishment player card associated with an account) into the card reader 512. Further, the virtual ticket converter 506 is able to detect whether the player has established the player session by the use of an application on a mobile device to initiate a wireless communications link between the player's mobile device and the EGM 502 (e.g., over Bluetooth).

Because the virtual ticket converter 506 intercepts communications between the peripheral devices (bill validator 510 and ticket printer 508) of the EGM 502, the virtual ticket converter 506 is able to control how financial transactions are conducted and routed based on a manner of how the player has established gameplay at the EGM 502. Thus, the virtual ticket converter 506 may instruct the EGM 502 to, subsequent to gameplay, print a physical ticket (as the EGM 502 normally would) when the virtual ticket converter 506 has detected that an "uncarded" player (i.e., a player whom has not established an account with the EGM 502 via a mobile wallet account nor has inserted a gaming establishment player card to establish a casino account) had first inserted actual bills or a physical ticket into the bill validator 510 to initiate the gameplay. Conversely, when a "carded" player has established a player session with the EGM 502 (via a player identification card or by linking their mobile wallet application to the EGM 502 wirelessly), the virtual ticket converter 506 may automatically facilitate performing cash-in operations or cash-out operations from the player's mobile wallet or casino account by "inserting" a virtual ticket into the bill validator 510 of the EGM 502, or "printing" a virtual ticket from the ticket printer 508 of the EGM 502 and automatically deducting or redeeming the funds associated with virtual ticket into/from the player's respective account.

That is, in the case of the cash-in operation, the virtual ticket converter 506 facilitates the deduction of funds from the player's mobile wallet or casino account (of which amount may be either selected by the player or automatically selected based upon the configuration of the game), converts these funds to a virtual ticket, and presents the virtual ticket to the EGM 502 over the bill validator 510 communications to the EGM 502. Thus, even though no physical ticket has been inserted, the EGM 502 considers a physical ticket to have been inserted by way of the instructions provided by the virtual ticket converter 506 over the SAS communications to the EGM 502 logic. An analogous operation is performed for cash-out operations, where, upon the player pressing a cash-out button or function on the EGM 502, the virtual ticket converter 506 intercepts the EGM 502 communications to the ticket printer 508 (which would normally instruct the ticket printer 508 to print a ticket or voucher), transacts with a ticketing system 516 to ensure the ticket issuance is recorded, virtually prints the ticket upon request by the EGM 502 (such as to effectively affirm to the EGM 502 that a physical ticket has been printed), and automatically redeem the ticket into the player's corresponding mobile wallet or casino account.

In various embodiments described herein and as depicted in the architecture 500, the EGM 502 is in communication with a casino management system 514, which provides accounting, governance, and managerial services corresponding to gameplay functionality of the EGM 502. In addition, the virtual ticket converter 506 communicates with the ticketing system 516, which handles ticketing issuance/redeeming functions while also communicating financial data held in the player's mobile wallet or casino account in a gaming establishment application 518 (e.g., "Resort Wallet"). The casino management system 514 may audit the EGM 502's ticket voucher in and out meter movements against reports exported by the ticketing system 516. In other words, each received and distributed virtual ticket handled by the EGM 502 may be audited against records contained by the ticketing system 516 to ensure a complete accounting of financial transactions received and distributed by the EGM 502.

It should be noted that the various components and systems depicted in the architecture 500 are manufactured, managed, or otherwise associated with differing sources. For example, the SMIB 504 and the casino management system 514 are casino system components, which may be related to a first manufacturer or provider. The virtual ticket converter 506, the card reader 512, the ticketing system 516, and the gaming establishment application 518 may be related to or provided by a second manufacturer. Moreover, the EGM 502 itself with its associated bill validator 510 and ticket printer 508 may be related to or provided by a third manufacturer. Thus, an advantageous aspect of the functionality disclosed herein is the integration between multiple components which may have been sourced from multiple sources, and by way of installing the virtual ticket converter 506 as a new SMIB 504 in the EGM 502, the mechanisms herein provide a cost-effective and efficient way of providing mobile wallet functionality to gaming machines and systems which otherwise would not be compatible with such applications.

Figure 6A:
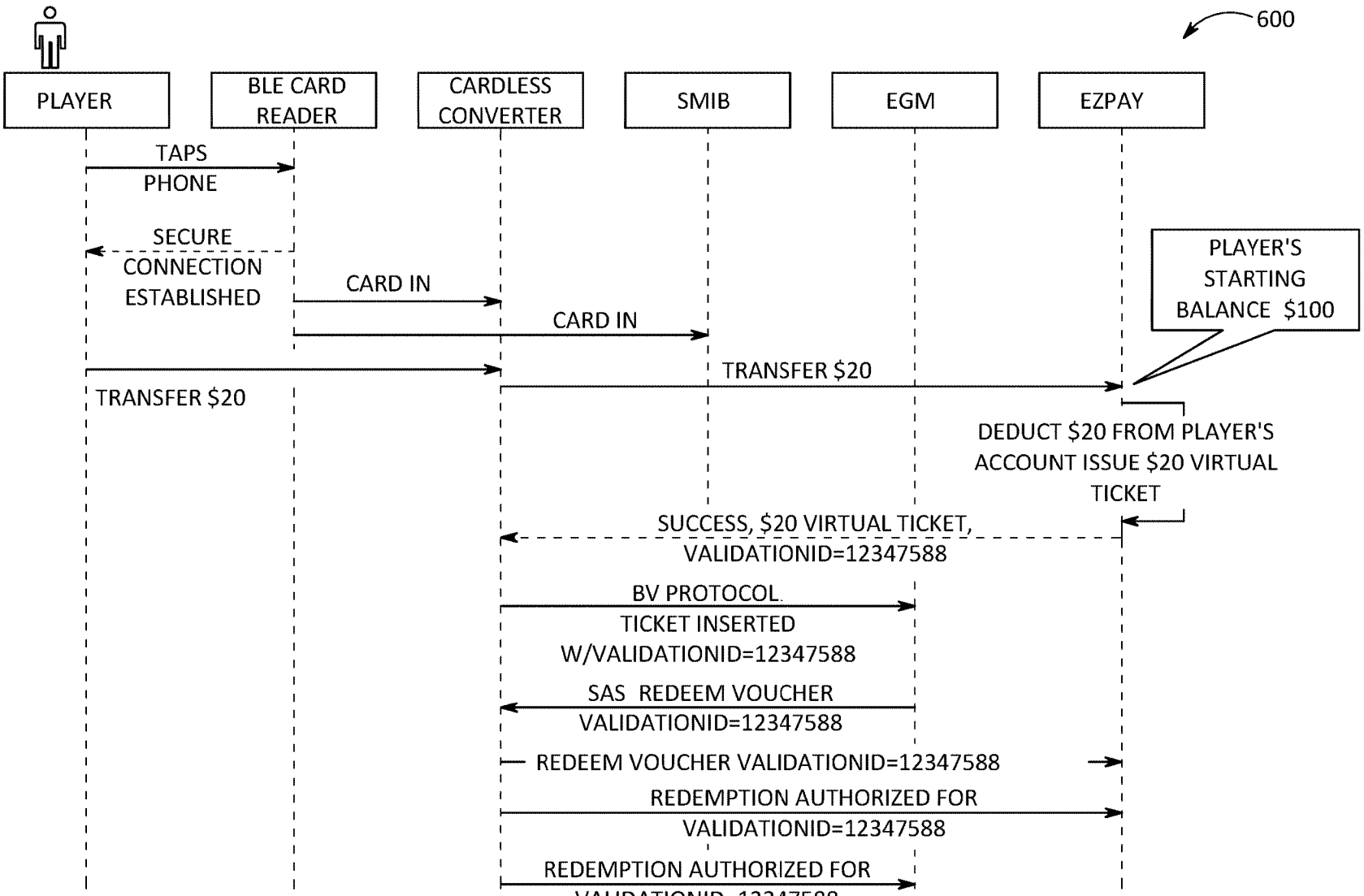
FIGS. 6A and 6B is a graph diagram illustrating a carded player cash-in procedure using the virtual ticketing system of FIG. 5.
Figure 6B:
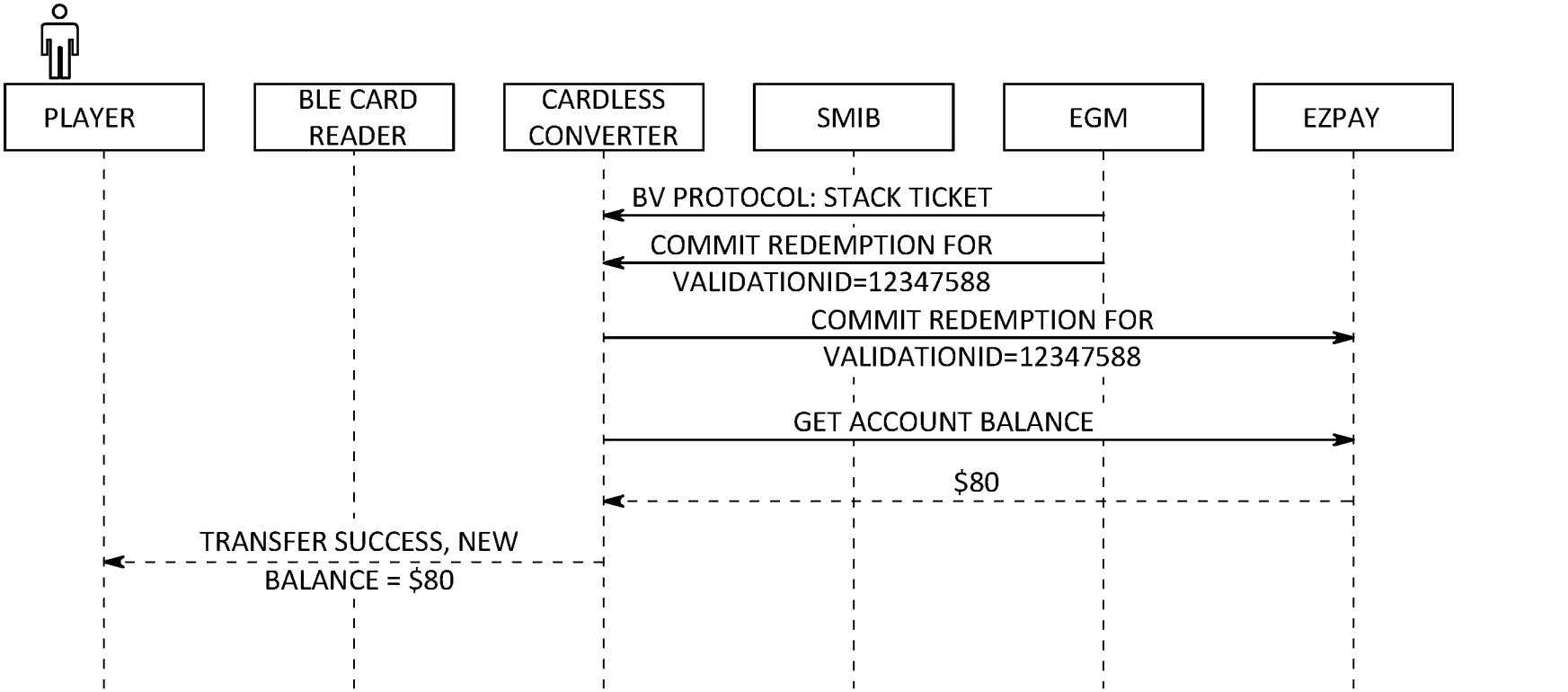
Figure 6C:
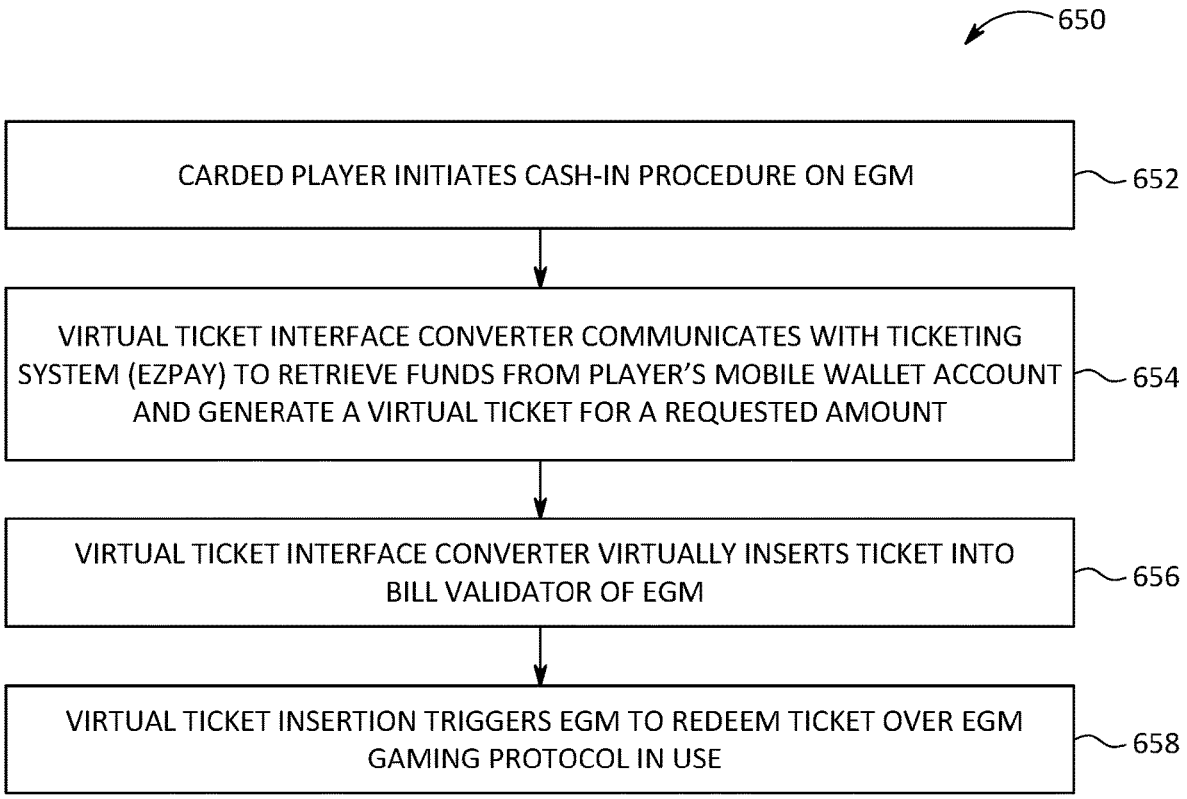
FIG. 6C is a flow chart illustrating an exemplary method for performing the carded player cash-in procedure using the virtual ticketing system of FIG. 5.

FIGS. 6A and 6B is a graph diagram illustrating a carded player cash-in procedure 600 using the virtual ticketing system architecture of FIG. 5, and FIG. 6C is a is a flow chart illustrating an exemplary method 650 for performing the carded player cash-in procedure 600. Again, a "carded" player is one whom is referred to as having established a player session with the particular EGM 502 the player is currently playing. This may entail wirelessly connecting, via the player's mobile device, to the EGM 502 using the gaming establishment application 518. In other embodiments, establishing the player session may entail physically inserting a gaming establishment card into the card reader 512 of the EGM 502, where the gaming establishment card links to a virtual account managed by the gaming establishment/casino. Referring now to cash-in procedure 600, the graph diagram illustrates an overall flow of messages transacted in the identified architecture when the carded player having a mobile wallet or casino account desires to establish a credit balance on the EGM 502.

As depicted in the cash-in procedure 600 and illustrated in the method 650, the carded player may desire to fund a balance on the EGM 502 to initiate gameplay. This cash-in may be performed (or initiated) on the player's mobile device upon the player selecting an associated option in the gaming establishment application 518. In one embodiment, when the carded player initiates the cash-in procedure on the EGM 502 (step 652), the virtual ticket converter 506 communicates with the ticketing system 516 to deduct and retrieve funds (e.g., of a player-specified or game-specified amount) from the player's mobile wallet or casino account balance. That is, as shown in FIGS. 6A and 6B, the virtual ticket converter 506 facilitates communications with the SMIB 504, the EGM 502, and the ticketing system 516 to initiate a series of messages to perform the cash-in transaction. The virtual ticket converter 506 then generates a virtual ticket for the requested amount (step 654). Upon generating the virtual ticket, the virtual ticket converter 506 virtually inserts the virtual ticket into the bill validator 510 (step 656) which triggers the EGM 502 to redeem the ticket over the gaming protocol in use (e.g., SAS, G2S, ASP, etc.). The virtual ticket converter 506 will then facilitate communications with the ticketing system 516 to handle the messages sent from the EGM 502 therebetween and redeem the ticket with the ticketing system 516 (step 658), which ultimately redeems and displays the respective balance of the funds transfer on the EGM 502. Again it should be noted that when virtually inserting the ticket into the bill validator 510, the virtual ticket converter 506 is effectively intercepting communications between the bill validator 510 and the EGM 502 such as to instruct the EGM 502 logic that a physical ticket has actually been inserted into the bill validator 510 (although none was done so). Moreover, in an alternative embodiment, rather than the virtual ticket converter 506 communicating with the ticketing system 516, the EGM 502 itself may communicate directly with the ticketing system 516, as would be possible with a clerk validation terminal (CVT) based EZPay® 2-wire network.

Figure 7A:
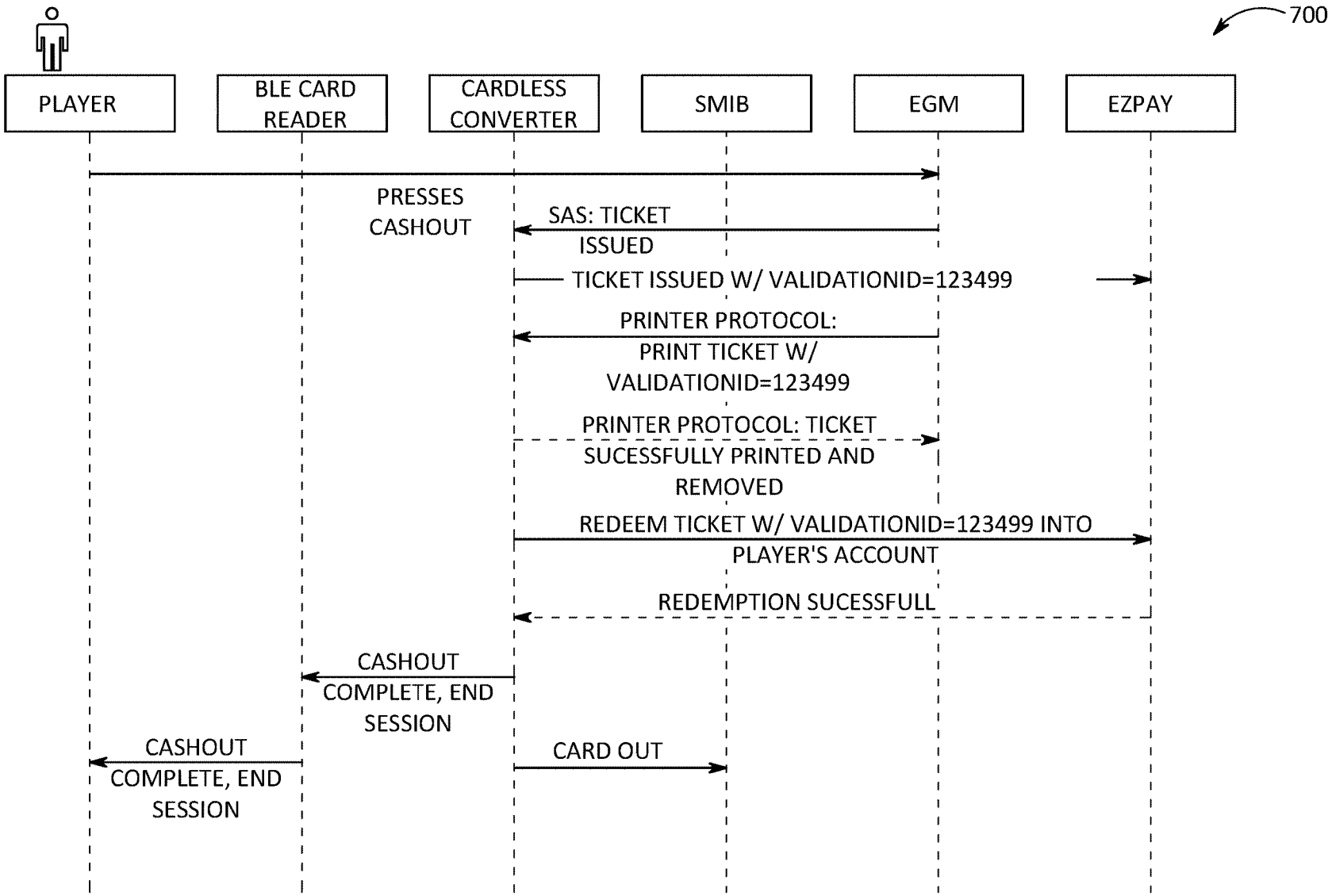
FIG. 7A is a graph diagram illustrating a carded player cash-out procedure using the virtual ticketing system of FIG. 5.
Figure 7B:
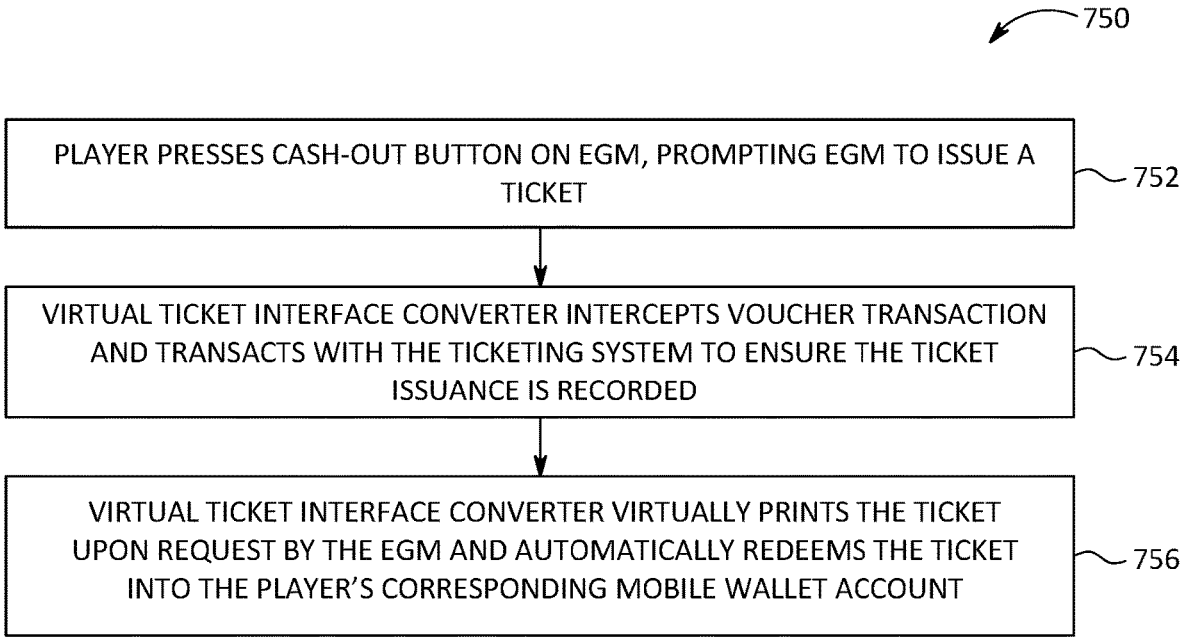
FIG. 7B is a flow chart illustrating an exemplary method for performing the carded player cash-out procedure using the virtual ticketing system of FIG. 5.

FIG. 7A is a graph diagram illustrating a carded player cash-out procedure 700 using the virtual ticketing system architecture of FIG. 5, and FIG. 7B is a is a flow chart illustrating an exemplary method 750 for performing the carded player cash-in procedure 700. As the carded player (having an existing player session) plays one or more games on the EGM 502, the player may wish to cash out a certain amount of money received as winnings, bonuses, etc. associated with their gameplay. The player first presses a cash-out button or selection on the EGM 502, which prompts the EGM 502 to generate and issue a physical ticket (step 752). The virtual ticket converter 506 then intercepts this communication that the EGM 502 will print a ticket and begins transacting with the ticketing system 516 to ensure the ticket issuance is recorded and accounted for (step 754). The virtual ticket converter 506 then virtually prints the ticket upon request by the EGM 502 (while letting the EGM 502 consider a physical ticket has been printed via communications with the ticket printer 508), and subsequently automatically redeems the ticket into the player's corresponding mobile wallet or casino account within the gaming establishment application 518 (step 756). Upon performing the redemption, the EGM 502 is then notified by the virtual ticket converter 506 that the cash-out session has successfully completed.

It should be noted that in the diagram of the cash-out procedure 700, the virtual ticket converter 506 is described as the entity which initiates the automatic redemption of the virtual ticket into the player's mobile wallet or casino account. This redemption may also be automatically performed by the ticketing system 516 (or other components of the cashless system) upon receipt of a ticket issuance message from the virtual ticket converter 506. In this scenario, however, the virtual ticket converter 506 would also need to identify to the ticketing system 516 which player is associated with the transaction so that the ticketing system 516 can transfer funds into the correct mobile wallet or casino account.

Figure 8A:
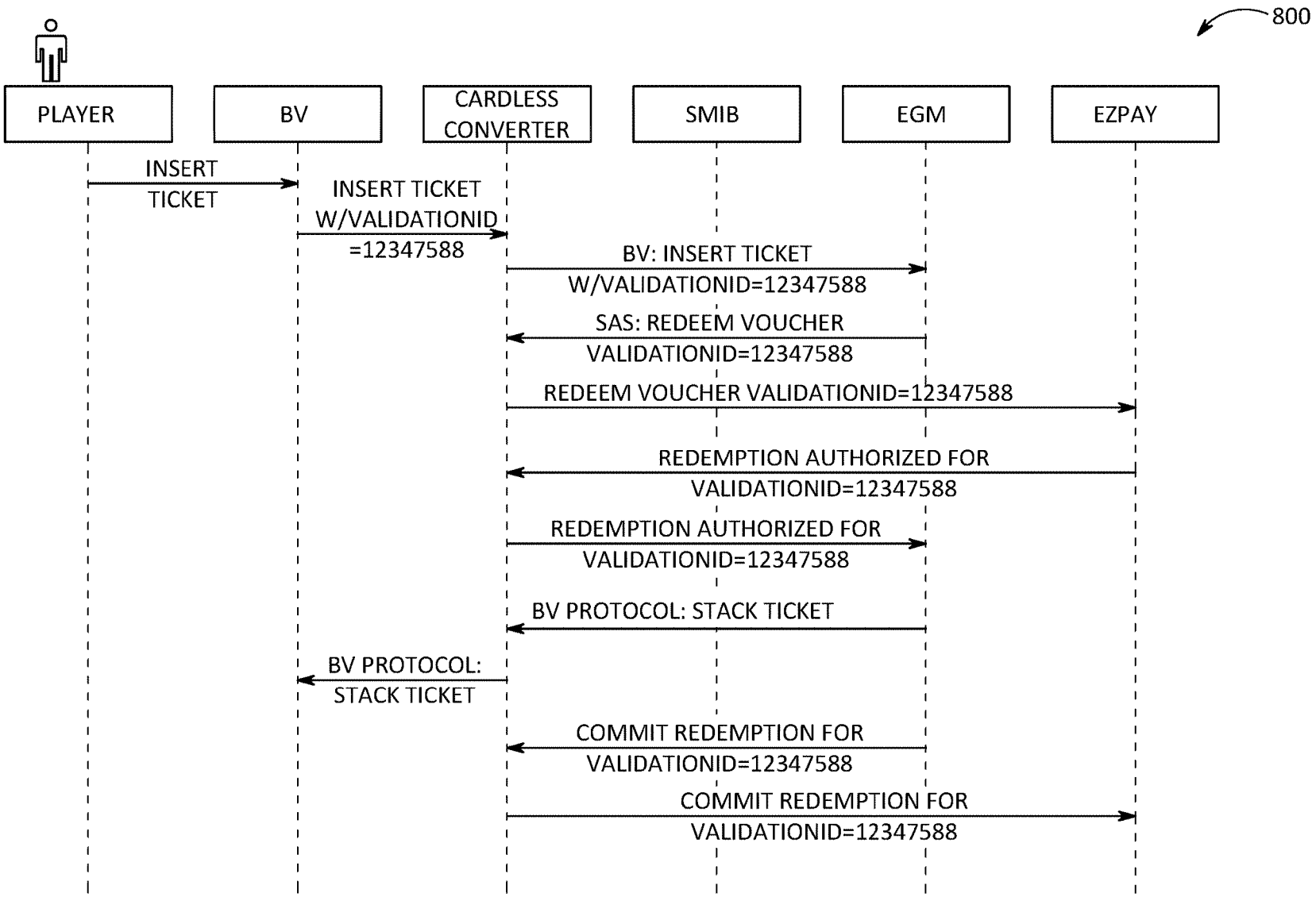
FIG. 8A is a graph diagram illustrating an un-carded player ticket redemption procedure using the virtual ticketing system of FIG. 5.
Figure 8B:
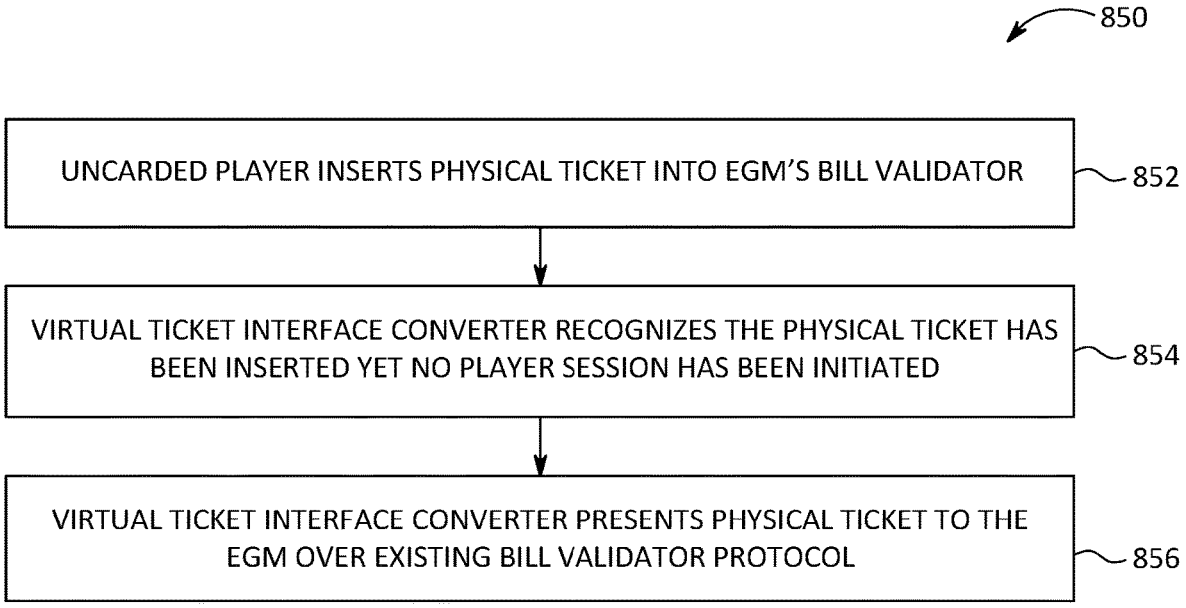
FIG. 8B is a flow chart illustrating an exemplary method for performing the un-carded player ticket redemption procedure using the virtual ticketing system of FIG. 5.

Following, FIG. 8A is a graph diagram illustrating an un-carded player ticket redemption procedure 800 using the virtual ticketing system architecture of FIG. 5, and FIG. 8B is a flow chart illustrating an exemplary method 850 for performing the un-carded player ticket redemption procedure 800. Again for clarity, it should be noted that the un-carded player comprises one whom has not established a player session with the EGM 502. That is, the un-carded player has not linked a mobile wallet or casino account via the gaming establishment application 518 on their mobile device to the EGM 502. Further, in some embodiments, this may also refer to a player whom has not inserted a player card associated with the gaming establishment into the EGM 502, or a linked gaming establishment account thereof.

As previously mentioned, one of the advantageous aspects of the disclosed functionality is the ability of the virtual ticket converter 506 to recognize what type of transaction the player uses to establish funding with the EGM 502, and perform the appropriate action. That is, the virtual ticket converter allows the EGM 502 to "behave" as normal if the player has not carded in and established a player session by physically accepting and printing tickets and vouchers. Thus, when the un-carded player inserts a physical ticket into the EGM 502's bill validator 510 (step 852), the virtual ticket converter 506 identifies that a physical ticket has been inserted into the bill validator 510 via communications with the EGM 502 and the respective components thereof (e.g., the virtual ticket converter 506 recognizes the player has not carded in and no player session is established through the EGM 502 and the card reader and Bluetooth module 512, and further identifies that a physical ticket has been inserted into the bill validator 510) (step 854). Upon identifying that the physical ticket has been inserted into the bill validator 510 and that no player session exists, the virtual ticket converter presents the physical ticket to the EGM 502 over the existing bill validator 510 protocol. The ticket is then redeemed for the balance thereof as the virtual ticket converter 506 transacts with the ticketing system 516 to commit the redemption on the EGM 502.

Figure 9:
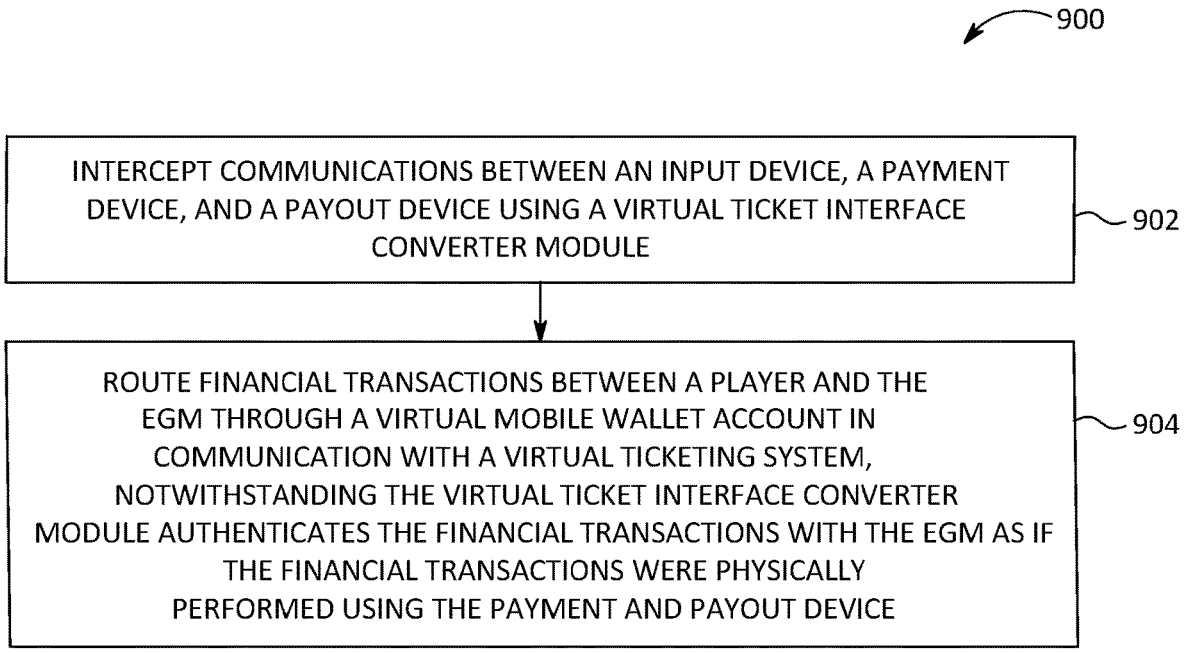
FIG. 9 is a flow chart illustrating an exemplary method for performing cashless financial transactions through a virtual ticketing in a gaming system.

FIG. 9 is a flow chart illustrating an exemplary method 900 for performing cashless financial transactions through a virtual ticketing in a gaming system. The method 900 begins by intercepting communications between an input device, a payment device and a payout device of an EGM using a virtual ticket interface converter module (step 902). Financial transactions between a player and the EGM are then routed by the virtual ticket interface converter module through a virtual mobile wallet account in communication with a virtual ticketing system, notwithstanding the virtual ticket interface converter module authenticates the financial transactions with the EGM as if the financial transactions were physically performed using the payment device and the payout device (step 904).

As will be appreciated by one skilled in the art, aspects of the present disclosure may be embodied as an apparatus, system, method or a computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system."

Aspects of the present disclosure have been described above with reference to flowchart illustrations and/or block diagrams of methods, apparatus, and systems according to embodiments of the disclosure. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks.

These computer program instructions may also be stored in a computer readable storage medium that may direct a computer, other programmable data processing apparatus, or other devices to function in a particular manner, such that the instructions stored in the computer readable storage medium produce an article of manufacture including instructions which implement the function/act specified in the flowcharts and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowcharts and/or block diagram block or blocks.

A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

The flowcharts and block diagrams in the above figures illustrate the architecture, functionality, and operation of possible implementations of systems, methods and computer program products according to various embodiments of the present disclosure. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

What is claimed is:

1. An electronic gaming machine (EGM) for use in a gaming system comprising:
a communication module;
a virtual ticket interface converter module;
an input device;
a payment device;
a payout device;
a memory device; and
a processor executing instructions stored in the memory device, wherein the instructions, when executed, cause the processor to:
intercept communications between the input device, the payment device and the payout device using the virtual ticket interface converter module such that financial transactions between a player and the EGM are routed through a virtual mobile wallet account notwithstanding the virtual ticket interface converter module authenticates the financial transactions with the EGM as if the financial transactions were physically performed using the payment device and the payout device, wherein the financial transactions comprise a cash-in operation;
perform the cash-in operation by retrieving funds from the virtual mobile wallet account and generating a virtual ticket for a requested funding amount;
virtually insert the virtual ticket into the payment device such that the payment device considers the virtual ticket to have been physically inserted into the payment device; and
upon virtually inserting the virtual ticket into the payment device trigger the EGM to redeem the virtual ticket by communicating with a virtual ticketing system over an existing EGM gaming protocol.

2. The EGM of claim 1, wherein the payment device comprises at least one selected from a list comprising a bill acceptor and a coin or a token slot;
wherein the payout device comprises a physical ticket printer; and
wherein the input device comprises a card reader for reading at least one selected from a list comprising a debit card, a credit card, and a player identification card.

3. The EGM of claim 2, wherein when executed by the processor, the instructions cause the processor to use the virtual ticket interface converter module to route the financial transactions to and from the virtual mobile wallet account by communicating with the virtual ticketing system.

4. The EGM of claim 2, wherein a communications module and the virtual ticket interface converter module connect to the virtual mobile wallet account through the virtual ticketing system using one selected from a list comprising a slot account system (SAS) protocol and a game-to-system (G2S) protocol.

5. The EGM of claim 3, wherein the financial transactions further comprise a cash-out operation; and
wherein when executed by the processor, the instructions cause the processor to establish a player session for performing the cash-in operation and the cash-out operation upon a player inserting the player identification card into the input device.

6. The EGM of claim 5, wherein when executed by the processor, the instructions cause the processor to work in conjunction with the virtual ticket interface converter module to, when the player session has been established:
intercept a cash-out ticket generated by the EGM upon the player performing the cash-out operation;
transact with the virtual ticketing system to ensure ticket issuance of the cash-out ticket is recorded;
virtually print the cash-out ticket using the payout device such that the payout device considers the cash-out ticket to have been physically printed; and
automatically redeem the cash-out ticket into the virtual mobile wallet account associated with the player.

7. The EGM of claim 5, wherein when executed by the processor, the instructions cause the processor to work in conjunction with the virtual ticket interface converter module to, when the player session has not been established:
identify that a physical ticket has been inserted into the payment device of the EGM; and
present the physical ticket to the EGM using an existing bill validator communications protocol established by the EGM.

8. The EGM of claim 5, wherein the instructions cause the processor to work in conjunction with the virtual ticket interface converter module to retrieve the funds from the virtual mobile wallet account while the player session is established.

9. A gaming system comprising:
a communications network;
a virtual ticketing system;
an electronic gaming machine (EGM), the EGM including a virtual ticket interface converter module;
a processor within the EGM; and
a memory device within the EGM that stores executable instructions which, when executed by the processor, cause the processor to:
intercept communications between an input device, a payment device and a payout device of the EGM using the virtual ticket interface converter module such that financial transactions between a player and the EGM are routed through a virtual mobile wallet account in communication with the virtual ticketing system, notwithstanding the virtual ticket interface converter module authenticates the financial transactions with the EGM as if the financial transactions were physically performed using the payment device and the payout device, wherein the financial transactions comprise a cash-out operation;
intercept a cash-out ticket generated by the EGM upon the player performing the cash-out operation;
transact with the virtual ticketing system to ensure ticket issuance of the cash-out ticket is recorded;
virtually print the cash-out ticket using the payout device such that the payout device considers the cash-out ticket to have been physically printed; and
automatically redeem the cash-out ticket into the virtual mobile wallet account associated with the player.

10. The gaming system of claim 9, wherein the payment device comprises at least one selected from a list comprising a bill acceptor and a coin or a token slot;
wherein the payout device comprises a physical ticket printer; and
wherein the input device comprises a card reader for reading at least one selected from a list comprising a debit card, a credit card, and a player identification card.

11. The gaming system of claim 9, wherein the financial transactions further comprise a cash-in operation; and wherein when executed by the processor, the instructions cause the processor to establish a player session for performing the cash-in operation and the cash-out operation upon a player inserting a player identification card into the input device.

12. The gaming system of claim 11, wherein when executed by the processor, the instructions cause the processor to work in conjunction with the virtual ticket interface converter module to, when the player session has been established:

perform the cash-in operation by retrieving funds from the virtual mobile wallet account and generating a virtual ticket for a requested funding amount;

virtually insert the virtual ticket into the payment device such that the payment device considers the virtual ticket to have been physically inserted into the payment device; and upon virtually inserting the virtual ticket into the payment device, trigger the EGM to redeem the virtual ticket by communicating with the virtual ticketing system over an existing EGM gaming protocol.

13. The gaming system of claim 11, wherein when executed by the processor, the instructions cause the processor to work in conjunction with the virtual ticket interface converter module to, when the player session has not been established:

identify that a physical ticket has been inserted into the payment device of the EGM; and present the physical ticket to the EGM using an existing bill validator communications protocol established by the EGM.

14. The gaming system of claim 11, wherein the instructions cause the processor to work in conjunction with the virtual ticket interface converter module to intercept the cash-out ticket generated by the EGM while the player session is established.

15. A method of operating a gaming system, by a processor, comprising:

intercepting communications between an input device, a payment device and a payout device of an electronic gaming machine (EGM) using a virtual ticket interface converter module;

routing financial transactions between a player and the EGM through a virtual mobile wallet account in communication with a virtual ticketing system, notwithstanding the virtual ticket interface converter module authenticates the financial transactions with the EGM as if the financial transactions were physically performed using the payment device and the payout device, wherein the financial transactions comprise a cash-in operation, performing the cash-in operation by retrieving funds from the virtual mobile wallet account and generating a virtual ticket for a requested funding amount;

virtually inserting the virtual ticket into the payment device such that the payment device considers the virtual ticket to have been physically inserted into the payment device; and upon virtually inserting the virtual ticket into the payment device, triggering the EGM to redeem the virtual ticket by communicating with the virtual ticketing system over an existing EGM gaming protocol.

16. The method of claim 15, wherein the payment device comprises at least one selected from a list comprising a bill acceptor and a coin or token slot;

wherein the payout device comprises a physical ticket printer; and wherein the input device comprises a card reader for reading at least one selected from a list comprising a debit card, a credit card, and a player identification card.

17. The method of claim 15, wherein the financial transactions further comprise a cash-out operation and wherein the method further comprises:

establishing a player session for performing the cash-in operation and the cash-out operation upon a player inserting a player identification card into the input device.

18. The method of claim 17, further comprising using the virtual ticket interface converter module to, when the player session has been established:

intercept a cash-out ticket generated by the EGM upon the player performing the cash-out operation;

transact with the virtual ticketing system to ensure ticket issuance of the cash-out ticket is recorded;

virtually print the cash-out ticket using the payout device such that the payout device considers the cash-out ticket to have been physically printed; and automatically redeem the cash-out ticket into the virtual mobile wallet account associated with the player.

19. The method of claim 17, further comprising using the virtual ticket interface converter module to, when the player session has not been established:

identify that a physical ticket has been inserted into the payment device of the EGM; and present the physical ticket to the EGM using an existing bill validator communications protocol established by the EGM.

20. The method of claim 17, wherein the virtual ticket interface converter module is used to retrieve the funds from the virtual mobile wallet account while the player session is established.

* * * * *